US010369425B2

(12) United States Patent
Mizutani et al.

(10) Patent No.: US 10,369,425 B2
(45) Date of Patent: Aug. 6, 2019

(54) GOLF CLUB

(71) Applicant: DUNLOP SPORTS CO. LTD., Kobe-shi, Hyogo (JP)

(72) Inventors: Naruhiro Mizutani, Kobe (JP); Daisuke Kohno, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 0 days.

(21) Appl. No.: 15/853,326

(22) Filed: Dec. 22, 2017

(65) Prior Publication Data

US 2018/0185710 A1 Jul. 5, 2018

(30) Foreign Application Priority Data

Dec. 29, 2016 (JP) ..... 2016-257180

(51) Int. Cl.

| | |
|---|---|
| ***A63B 53/06*** | (2015.01) |
| ***A63B 53/02*** | (2015.01) |
| ***A63B 53/04*** | (2015.01) |
| *A63B 53/08* | (2015.01) |

(52) U.S. Cl.

CPC ..... *A63B 53/02* (2013.01); *A63B 53/0466* (2013.01); *A63B 53/047* (2013.01); *A63B 53/0487* (2013.01); *A63B 53/08* (2013.01); *A63B 2053/023* (2013.01); *A63B 2053/0433* (2013.01)

(58) Field of Classification Search

CPC ..... A63B 53/02; A63B 53/0466; A63B 53/08; A63B 53/0487; A63B 2053/0433; A63B 53/047; A63B 2053/023

See application file for complete search history.

(56) References Cited

U.S. PATENT DOCUMENTS

| | | | | |
|---|---|---|---|---|
| 2,219,670 | A * | 10/1940 | Wettlaufer | A63B 53/06 473/247 |
| 7,789,769 | B2 * | 9/2010 | Sugimoto | A63B 53/02 473/307 |
| 8,632,417 | B2 * | 1/2014 | Sander | A63B 53/00 473/307 |
| 9,192,823 | B2 * | 11/2015 | Cole | A63B 53/06 |
| 9,364,723 | B2 | 6/2016 | Harvell et al. | |

(Continued)

FOREIGN PATENT DOCUMENTS

JP 04156869 A * 5/1992

*Primary Examiner* — Stephen L Blau

(74) *Attorney, Agent, or Firm* — Birch, Stewart, Kolasch & Birch LLP

(57) ABSTRACT

A sleeve 8 includes an engaging projection part P1. A head 2 includes an engaging recess part R1. The engaging projection part P1 includes a first side surface P11 located on a side receiving a rotating force caused by hitting, a second side surface P12 located on an opposite side to the first side surface P11, and an outer surface P13. The engaging recess part R1 includes a first opposed surface R11 opposed to the surface P11, a second opposed surface R12 opposed to the surface P12, and an inner surface R13 opposed to the surface P13. The engaging projection part P1 has a tapered projection part TP1. The tapered projection part TP1 has a maximum width of not less than an opening width of the engaging recess part R1. At least one of the first side surface and the first opposed surface extends along an axial direction.

17 Claims, 27 Drawing Sheets

(56) References Cited

U.S. PATENT DOCUMENTS

| | | | | |
|---|---|---|---|---|
| 2008/0280693 | A1* | 11/2008 | Chai | A63B 53/02<br>473/288 |
| 2009/0062029 | A1* | 3/2009 | Stites | A63B 53/00<br>473/288 |
| 2009/0197698 | A1* | 8/2009 | Morris | A63B 53/02<br>473/309 |
| 2009/0286618 | A1* | 11/2009 | Beach | A63B 53/0466<br>473/307 |
| 2014/0213386 | A1* | 7/2014 | Yamamoto | A63B 53/00<br>473/307 |

* cited by examiner

GOLF CLUB

The present application claims priority on Patent Application No. 2016-257180 filed in JAPAN on Dec. 29, 2016, the entire contents of which are hereby incorporated by reference.

BACKGROUND OF THE INVENTION

Field of the Invention

The present invention relates to a golf club.

Description of the Related Art

A golf club in which a shaft is detachably attached to a head has been proposed. As disclosed in US2009/0286618 and U.S. Pat. No. 9,364,723, a sleeve is fixed to the tip end portion of a shaft, and the sleeve is fixed to a head with a screw. In these golf clubs, a mechanism (rotation-preventing mechanism) for preventing a rotation of the sleeve with respect to the head is used.

SUMMARY OF THE INVENTION

It was considered that the rotation-preventing mechanism in above-mentioned literatures functions completely. However, the inventors of the present application have found that there is room to improve the rotation-preventing mechanism.

The present disclosure shows a golf club in which a shaft is detachably attached to a head and which can eliminate a strange feeling upon impact.

In one aspect, a golf club may include a shaft, a head having a hosel hole, a sleeve fixed to a tip end portion of the shaft, and a screw which can be screw-connected to the sleeve. The sleeve may have an engaging projection part. The head may have an engaging recess part. A rotation of the sleeve with respect to the hosel hole may be regulated based on an engagement between the engaging projection part and the engaging recess part. Falling off of the sleeve from the hosel hole may be regulated based on a connection between the screw and the sleeve inserted into the hosel hole. The engaging projection part may have a first side surface located on a side which receives a rotating force caused by hitting, a second side surface located on an opposite side to the first side surface, and an outer surface which extends between the first side surface and the second side surface. The engaging recess part may have a first opposed surface opposed to the first side surface, a second opposed surface opposed to the second side surface, and an inner surface opposed to the outer surface. The engaging projection part may have a tapered projection part formed such that a distance between the first side surface and the second side surface decreases toward a tip end of the sleeve. The tapered projection part may have a maximum width of equal to or greater than an opening width of the engaging recess part. At least one of the first side surface and the first opposed surface may extend along an axial direction.

In another aspect, the first side surface and the first opposed surface may extend along the axial direction.

In another aspect, the engaging recess part may have a tapered recess part formed such that a distance between the first opposed surface and the second opposed surface decreases toward the tip end of the sleeve.

In another aspect, the outer surface may have an outer inclination surface inclined so as to go toward a radial-direction inner side as approaching to the tip end of the sleeve.

In another aspect, the inner surface may have an inner inclination surface inclined so as to go toward the radial-direction inner side as approaching to the tip end of the sleeve.

BRIEF DESCRIPTION OF THE DRAWINGS

FIG. 26(*b*) is a schematic view showing an engaging projection part and an engaging recess part according to another embodiment; FIG. 27(*b*) is a schematic view showing an engaging projection part and an engaging recess part according to another embodiment.

DESCRIPTION OF THE PREFERRED EMBODIMENTS

Hereinafter, preferred embodiments will be described with appropriate references to the accompanying drawings.

Unless otherwise described, "an axial direction" in the present application means a direction of a center line of a hosel hole. The axial direction is the direction of a center line z1 explained later. Unless otherwise described, "a radial direction" in the present application means a radial direction of the hosel hole. Unless otherwise described, "a lower side" in the present application means an axial-direction sole side, and "an upper side" means an axial-direction grip side.

[First Embodiment]

Figure 1:
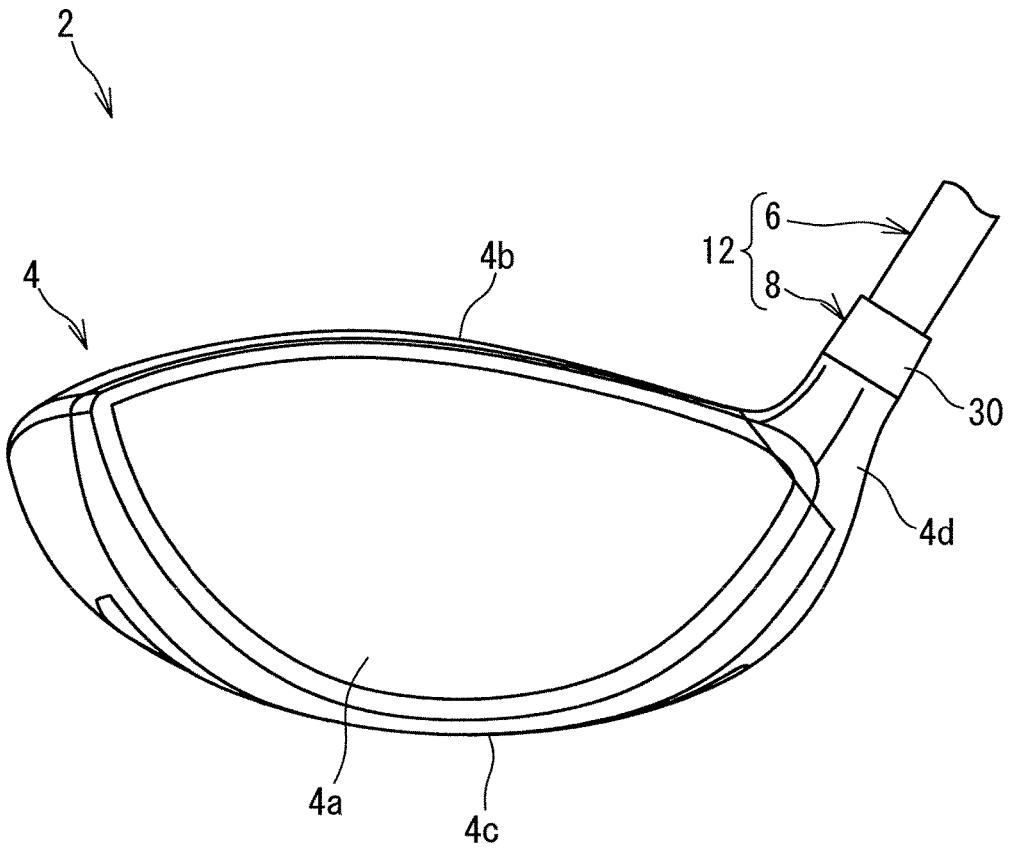
FIG. 1 shows a golf club according to a first embodiment.
Figure 2:
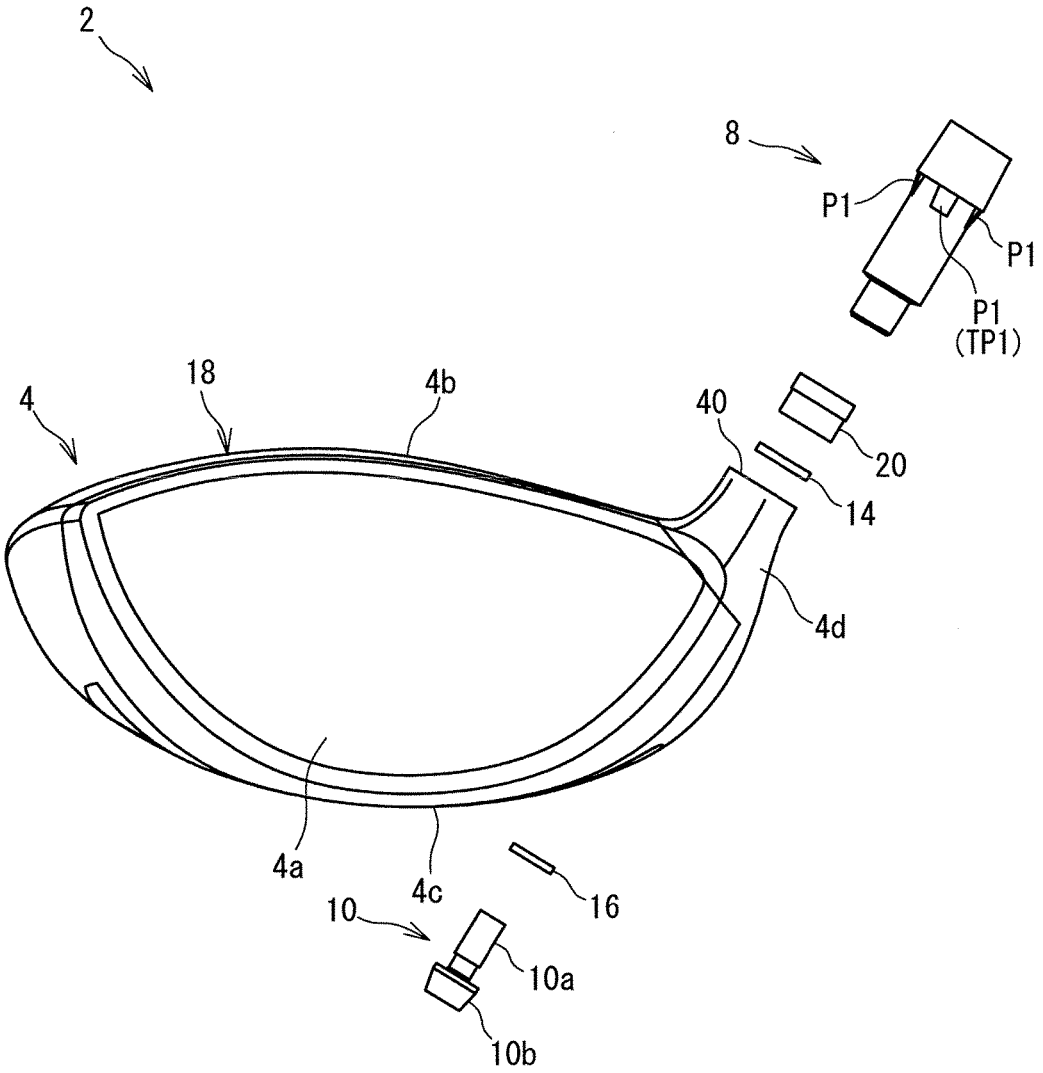
FIG. 2 is an exploded view of the golf club in FIG. 1.
Figure 3:
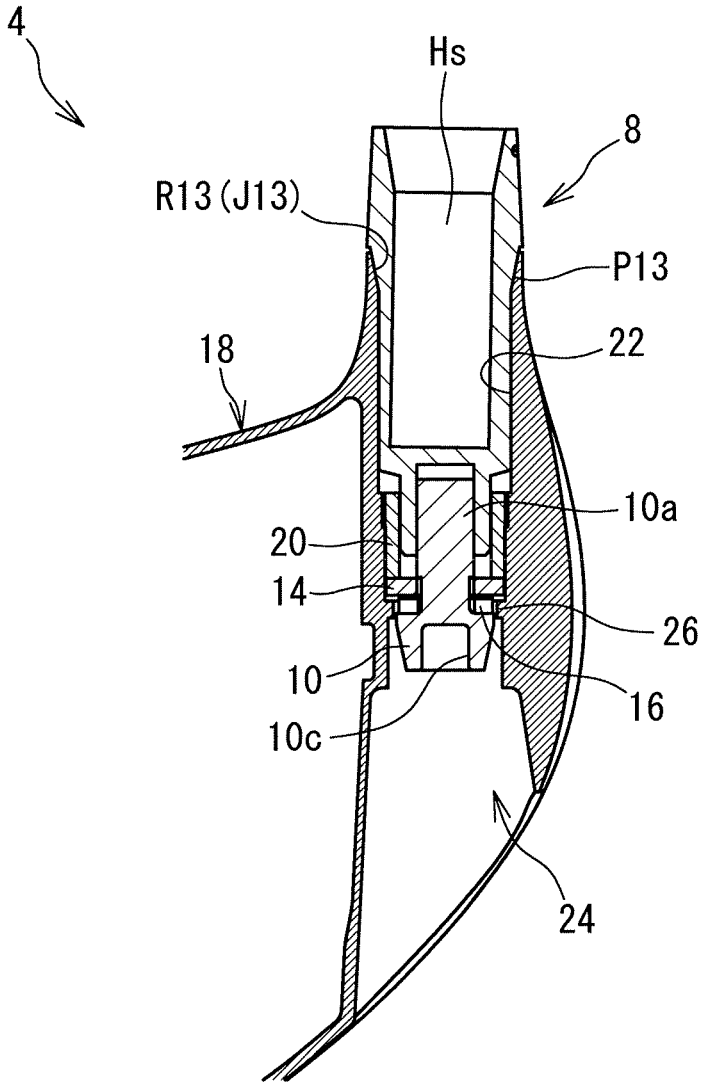
FIG. 3 is a sectional view of the golf club in FIG. 1.

FIG. 1 shows a golf club 2 according to a first embodiment. FIG. 1 shows only the vicinity of a head of the golf club 2. FIG. 2 is an exploded view of the golf club 2. In FIG. 2, a shaft and a grip are not shown. FIG. 3 is a sectional view of the golf club 2. FIG. 3 is a sectional view taken along a center line of a sleeve 8.

The golf club 2 has a head 4, a shaft 6, the sleeve 8, and a screw 10. As shown in FIG. 2, the golf club 2 further has an intermediate member 14 and a washer 16.

The head 4 has a face 4*a*, a crown 4*b*, a sole 4*c*, and a hosel 4*d*.

The head 4 is a wood type head. The head 4 is a driver head. The type of the head 4 is not limited in the present disclosure. Examples of the head 4 include a wood type head, a utility type head, a hybrid type head, an iron type head, and a putter head. The shaft 6 is not limited, and a carbon shaft, a steel shaft, etc. which have been generally used may be used.

The sleeve 8 is fixed to a tip end portion of the shaft 6. The method of the fixation is adhesion with an adhesive. A grip which is not shown in the drawings is attached to a butt end portion of the shaft 6. The shaft 6 and the sleeve 8 are fixed to each other to form a shaft 12 with the sleeve.

The screw 10 has a male screw part 10*a* and a head part 10*b*. The male screw part 10*a* can be screw-connected to a screw hole Ht of the sleeve 8. The head part 10*b* has a recess part 10*c* which receives a tool. In FIG. 2 and FIG. 3, a male screw of the male screw part 10*a* is not depicted.

The sleeve 8 (shaft 12 with the sleeve) is fixed to the head 4 by tightening the screw 10. This fixed state is also referred to as a connected state in the present application. FIG. 3 is a sectional view in the connected state. The fixation between the head 4 and the shaft 12 with the sleeve is released by loosening the screw 10. This released state from the fixation is also referred to as a separated state in the present application. The shaft 6 is detachably attached to the head 4.

Unless otherwise described, structures shown in the present application mean a structure in the connected state.

The intermediate member 14 is a ring-shaped member. The outer surface of the intermediate member 14 is a circumferential surface. Although not shown in the drawings, the inner surface of the intermediate member 14 forms a female screw. The intermediate member 14 has a function of preventing the screw 10 from falling off. This function is detailed later.

Needless to say, the intermediate member 14 may not be present. When a falling-off prevention function for the screw 10 is unnecessary, the intermediate member 14 is also unnecessary. Even when a falling-off prevention function for the screw 10 is required, the intermediate member 14 might be unnecessary. For example, a head body 18 may include a flange having the same shape as the shape of the intermediate member 14. An O-ring may be used instead of the intermediate member 14. A falling-off prevention function can be fulfilled by setting the inner diameter of the O-ring such that the male screw part 10*a* of the screw 10 is inserted into and retained by the O-ring.

Figure 4:
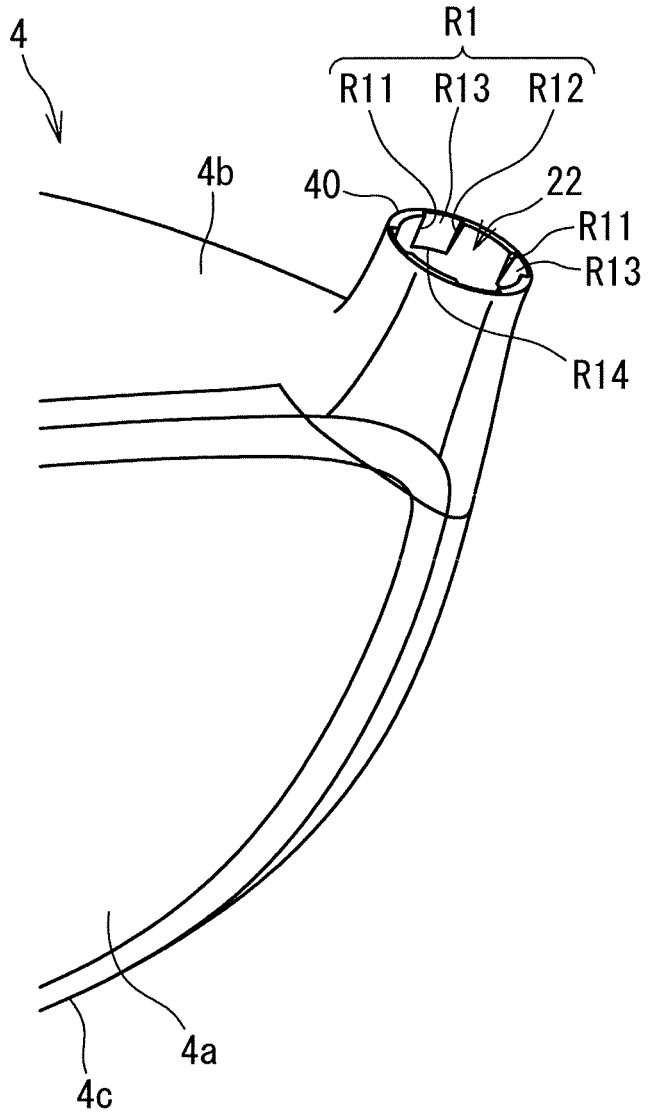
FIG. 4 is a perspective view of a head according to the first embodiment.
Figure 5:
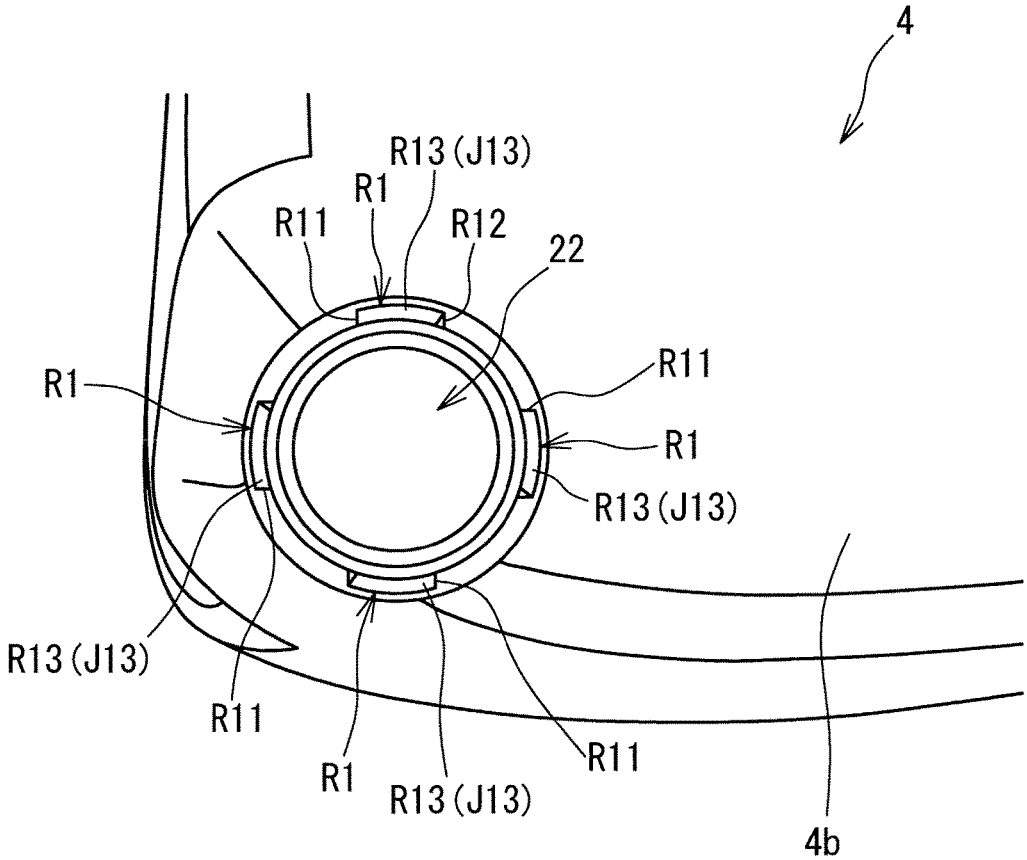
FIG. 5 is a plan view of the head in the vicinity of a hosel according to the first embodiment.
Figure 6:
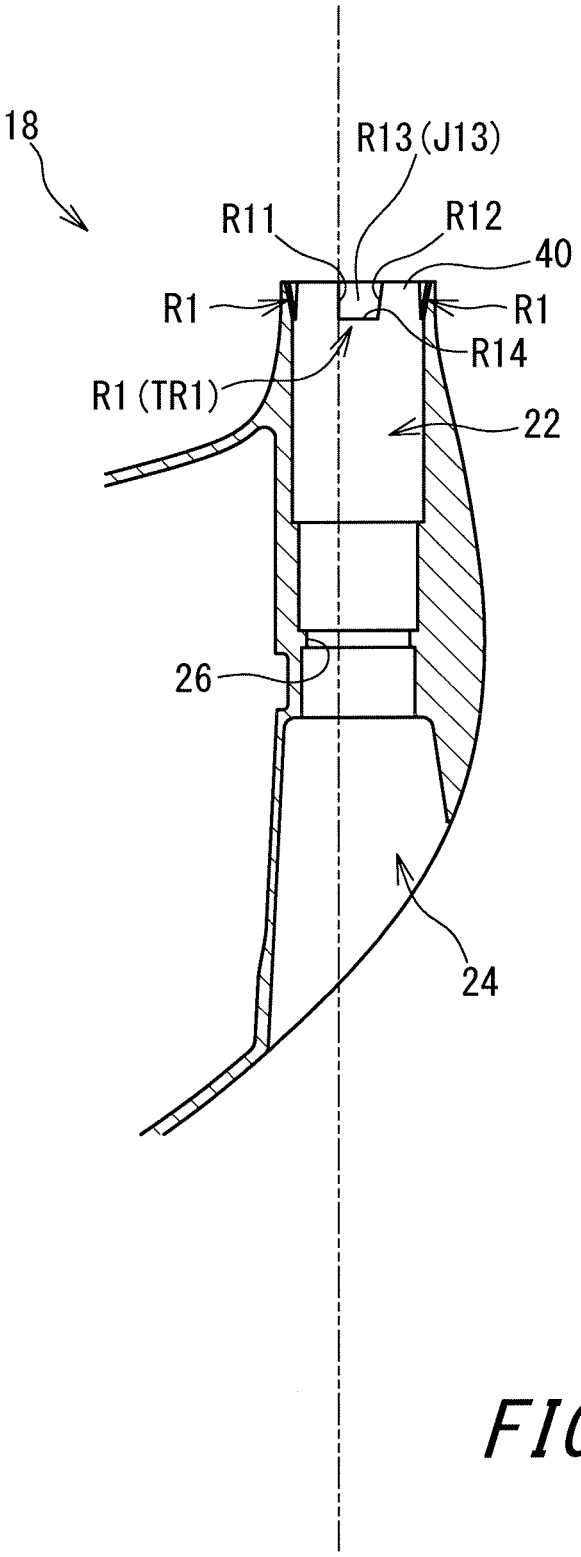
FIG. 6 is a sectional view of a head body according to the first embodiment.

FIG. 4 is a perspective view showing a hosel part of the head 4. FIG. 5 is a plan view of the hosel part of the head 4. FIG. 6 is a sectional view of the head body 18.

The head 4 is a hollow golf club head. The head 4 has the head body 18 and a cylindrical member 20 (see FIG. 2).

The head body 18 has a hosel hole 22 (see FIG. 4, FIG. 5, and FIG. 6). The sleeve 8 is inserted to the hosel hole 22. The sleeve 8 is supported by the hosel hole 22 in the connected state. The head body 18 has a through-hole 24 to which the screw 10 is inserted (see FIG. 3 and FIG. 6). The through-hole 24 penetrates through a bottom part of the hosel hole 22 to reach the sole. The through-hole 24 is opened toward the lower side.

As shown in FIG. 3 and FIG. 6, the head body 18 has a flange 26. In the connected state, the flange 26 is located on the lower side of the sleeve 8. As shown in FIG. 3, the inner diameter of the flange 26 is greater than the outer diameter of the washer 16. As shown in FIG. 3, the outer diameter of the intermediate member 14 is greater than the inner diameter of the flange 26.

As shown in FIG. 4, FIG. 5, and FIG. 6, the head 4 (hosel hole 22) has an engaging recess part R1. The engaging recess part R1 is provided on (the inner surface of) the hosel hole 22. The engaging recess part R1 is provided at an upper end of the hosel hole 22.

A plurality of engaging recess parts R1 are provided. The engaging recess parts R1 are arranged at equal intervals in a circumferential direction. The engaging recess parts R1 are arranged at intervals of a predetermined angle in the circumferential direction. In the present embodiment, four engaging recess parts R1 are provided. The engaging recess parts R1 are arranged at 90-degree intervals in the circumferential direction. The plurality of (four) engaging recess parts R1 have the same shape. The plurality of engaging recess parts R1 are varied only in their circumferential-direction positions.

The outer surface of the cylindrical member 20 is a circumferential surface. As shown in FIG. 2, the outer surface of the cylindrical member 20 has a larger-diameter part and a smaller-diameter part. Although not shown in the drawing, the inner surface of the cylindrical member 20 is a circumferential surface. The inner diameter of the circumferential surface corresponds to the outer diameter of a lower part 34 (described later) of the sleeve 8.

Needless to say, the cylindrical member 20 may not be present. For example, the head body 18 may have a shape equivalent to the cylindrical member 20. Since a middle part 32 of the sleeve 8 is supported by the hosel hole 22, there is no problem even if there is no support by the cylindrical member 20.

Figure 7:
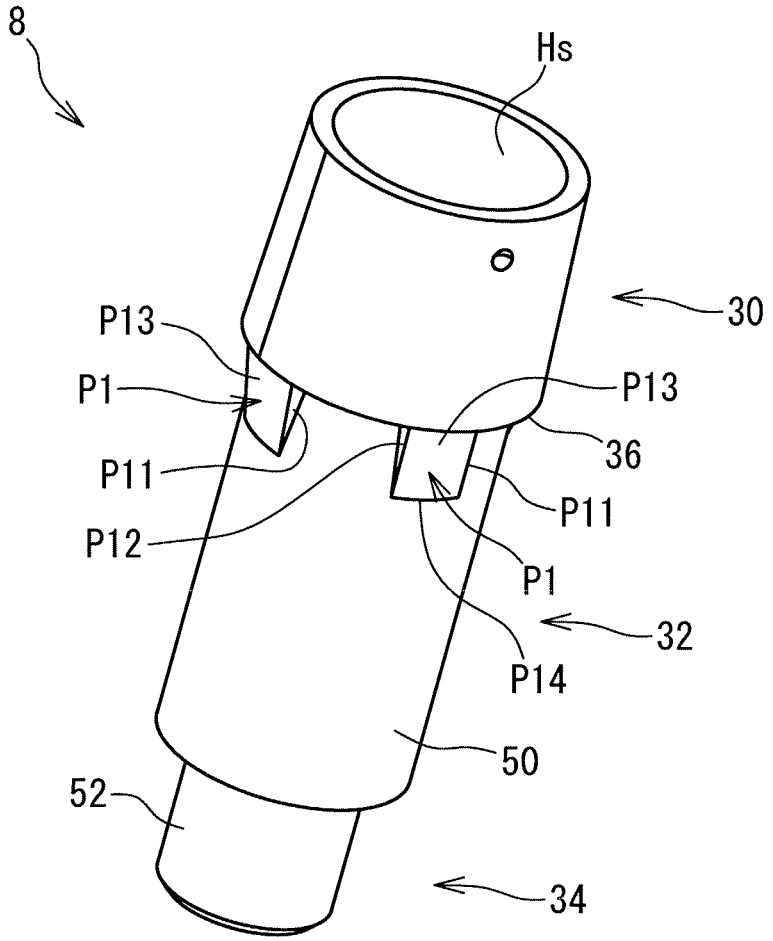
FIG. 7 is a perspective view of a sleeve according to the first embodiment.
Figure 8:
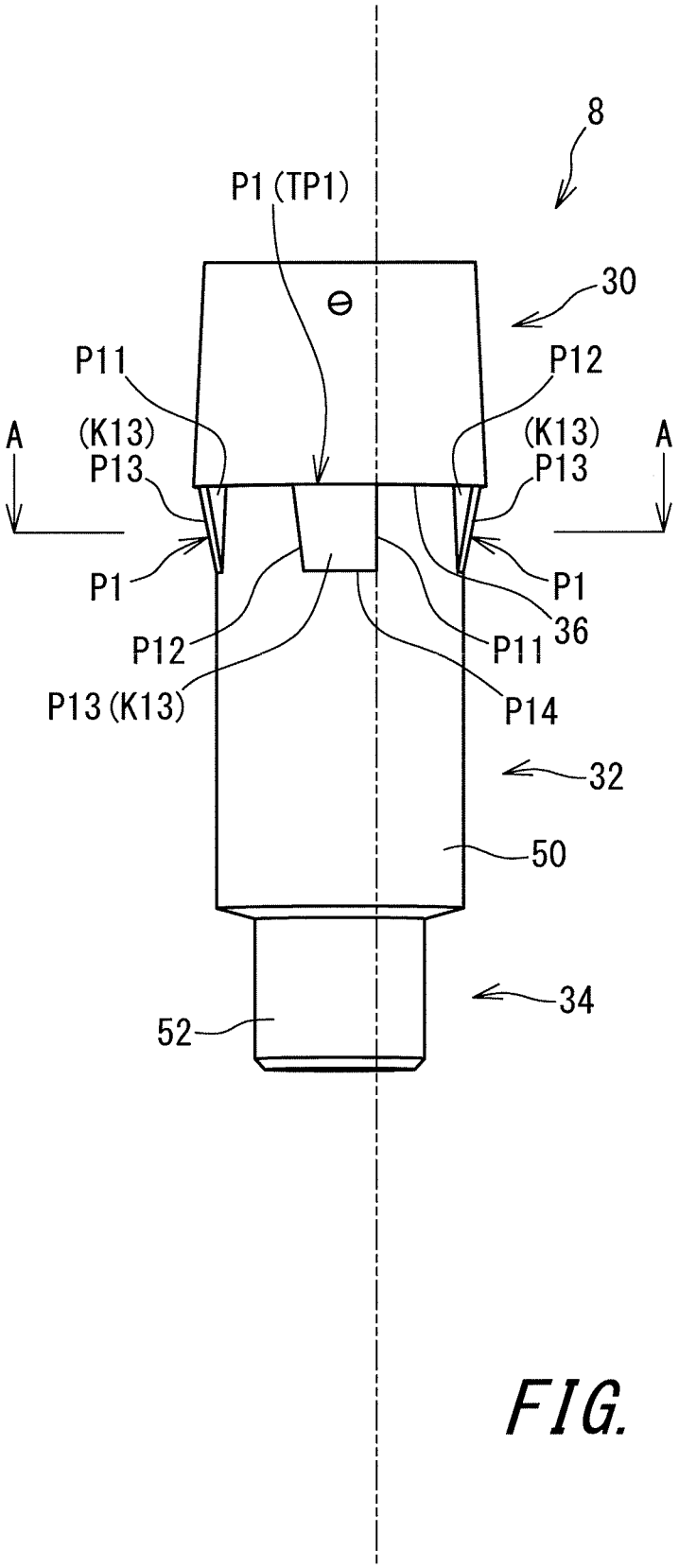
FIG. 8 is a side view of the sleeve in FIG. 7.
Figure 9:
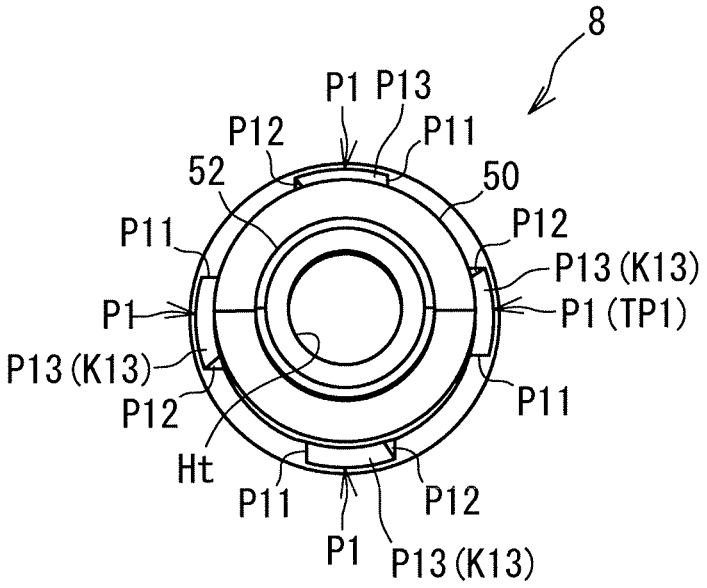
FIG. 9 is a bottom view of the sleeve in FIG. 7.
Figure 10:
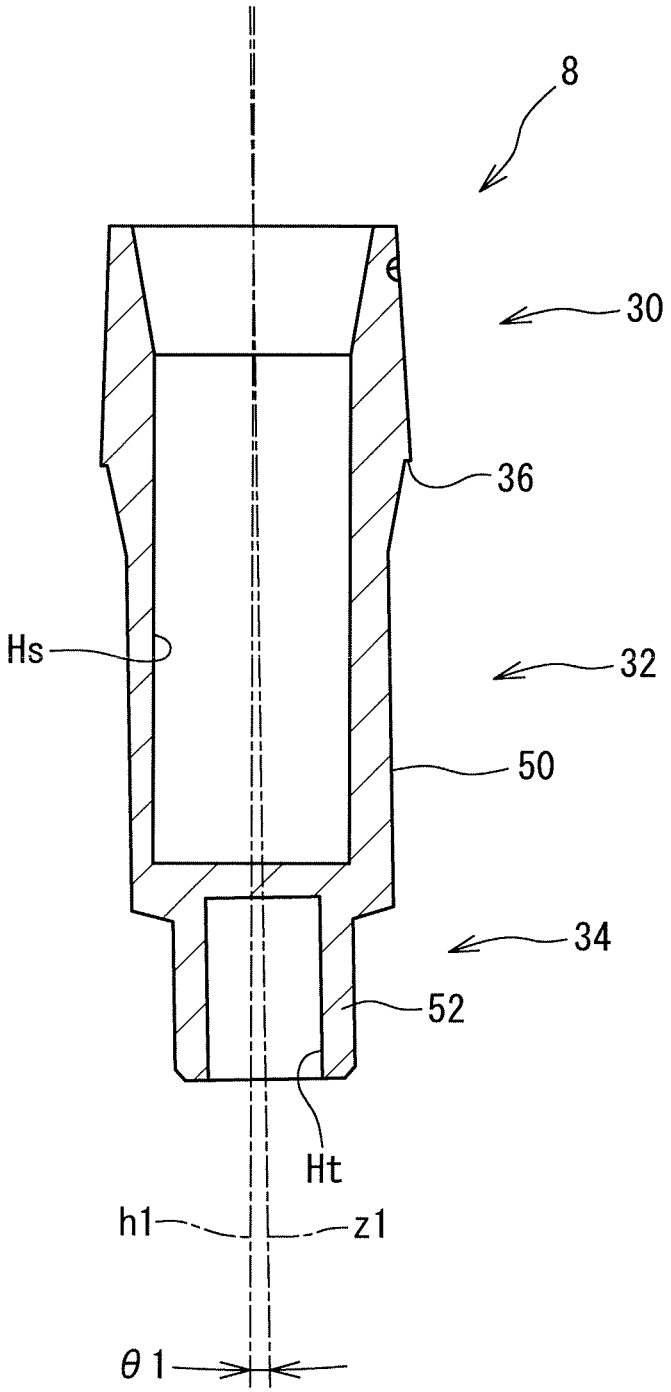
FIG. 10 is a sectional view of the sleeve in FIG. 7.
Figure 11:
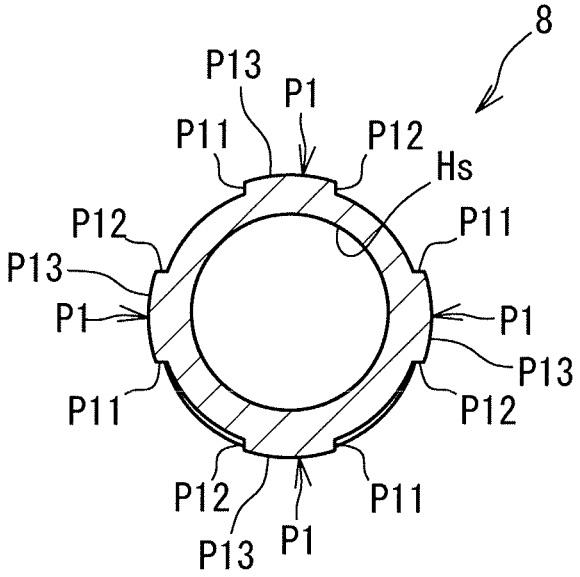
FIG. 11 is a sectional view taken along line A-A in FIG. 8.

FIG. 7 is a perspective view of the sleeve 8. FIG. 8 is a side view of the sleeve 8. FIG. 9 is a bottom view of the sleeve 8. FIG. 10 is a sectional view of the sleeve 8. FIG. 11 is a sectional view taken along line A-A in FIG. 8.

The sleeve 8 has an upper part 30, the middle part 32, and the lower part 34. A step surface 36 exists at a boundary between the upper part 30 and the middle part 32. The sleeve 8 has a shaft hole Hs and the screw hole Ht. The shaft hole Hs is located inside the upper part 30 and the middle part 32. The shaft hole Hs is opened toward one side (upper side) of the sleeve 8. The screw hole Ht is opened toward the other side (lower side) of the sleeve 8. The screw hole Ht is located inside the lower part 34.

The upper part 30 is exposed in the connected state. In the connected state, the step surface 36 does not abut on a hosel end surface 40 of the head 4. A (slight) gap is present between the step surface 36 and the hosel end surface 40. Upper ends of the engaging recess parts R1 are located at the hosel end surface 40.

As shown in FIG. 1, the outer diameter of a lower end of the upper part 30 is substantially equal to the outer diameter of the hosel end surface 40. In the connected state, the upper part 30 has an appearance like a ferrule. In the connected state, the middle part 32 and the lower part 34 are located inside the hosel hole 22.

The outer surface of the middle part 32 of the sleeve 8 has a circumferential surface 50. In the connected state, the circumferential surface 50 is brought into contact with the hosel hole 22. The circumferential surface 50 is brought into surface-contact with a circumferential surface of the hosel hole 22. This contact contributes to holding of the sleeve 8.

The outer surface of the lower part 34 of the sleeve 8 is a circumferential surface. The lower part 34 of the sleeve 8 has a screw-hole containing part 52. The screw-hole containing part 52 contains the screw hole Ht inside thereof. In FIG. 10, a female screw in the screw hole Ht is not depicted.

As shown in FIG. 10, a center line h1 of the shaft hole Hs is inclined with respect to a center line z1 of the outer surface (circumferential surface 50) of the sleeve 8. An inclination angle θ1 shown in FIG. 10 is an angle between the center line h1 and the center line z1. In the connected state, the center line z1 is equal to the center line of the hosel hole 22. The center line h1 of the shaft hole Hs is equal to the center line of the shaft 6. A loft angle, a lie angle, and a face angle can be adjusted by the inclination angle θ1.

The sleeve 8 has an engaging projection part P1. The engaging projection part P1 is provided on an outer circumferential surface of the sleeve 8. The engaging projection part P1 is provided on the circumferential surface 50. The engaging projection part P1 is provided at an upper end of the circumferential surface 50. An upper end of the engaging projection part P1 is located at the step surface 36.

A plurality of engaging projection parts P1 are provided on the sleeve 8. The engaging projection parts P1 are arranged at equal intervals in the circumferential direction. The engaging projection parts P1 are arranged at intervals of a predetermined angle in the circumferential direction. In the present embodiment, four engaging projection parts P1 are provided. The engaging projection parts P1 are arranged at 90-degree intervals in the circumferential direction. The plurality of (four) engaging projection parts P1 have the same shape. The plurality of engaging projection parts P1 are varied only in their circumferential-direction positions.

These engaging projection parts P1 are engaged with the above-mentioned engaging recess parts R1. The engaging projection parts P1 are engaged with the respective engaging recess parts R1. A rotation of the sleeve 8 with respect to the head 4 is regulated by the engagement.

As shown in FIG. 3, the cylindrical member 20 is fixed to (a lower part of) the hosel hole 22. The fixation can be attained by adhesion, welding, etc. The lower part 34 of the sleeve 8 is inserted to the cylindrical member 20 in the connected state. The cylindrical member 20 supports the lower part 34.

As shown in FIG. 3, the intermediate member 14 is located between the cylindrical member 20 and the flange 26. An axial-direction distance between the cylindrical member 20 and the flange 26 is greater than an axial-direction length of the intermediate member 14. The intermediate member 14 is not fixed to the hosel hole 22. The intermediate member 14 can move between the cylindrical member 20 and the flange 26.

In the connected state shown in FIG. 3, an axial force caused by tightening the screw 10 is transmitted to the cylindrical member 20 through the washer 16 and the intermediate member 14. The cylindrical member 20 receives the upward axial force.

The intermediate member 14 prevents the screw 10 in the separated state from falling off. The screw 10 is tightened in the connected state shown in FIG. 3. The screw 10 moves toward the lower side with respect to the sleeve 8 as the screw 10 is loosened. When the screw 10 is further loosened, the male screw part 10*a* of the screw 10 reaches the intermediate member 14. As above mentioned, the inner surface of the intermediate member 14 is a female screw. The female screw conforms to the male screw part 10*a*. When the screw 10 is further loosened, the male screw part 10*a* is screw-connected to the intermediate member 14. When the male screw part 10*a* comes out of the screw hole Ht, the male screw part 10*a* is screw-connected to the intermediate member 14. Even when the male screw part 10*a* is come out of the screw hole Ht and the shaft 12 with the sleeve is detached from the head 4, the screw 10 which is screw-connected to the intermediate member 14 does not fall off from the head 4. Since the screw 10 is held by the head 4, re-connection can be performed smoothly. In addition, the loss of the screw 10 is prevented.

[Second Embodiment]

Figure 12:
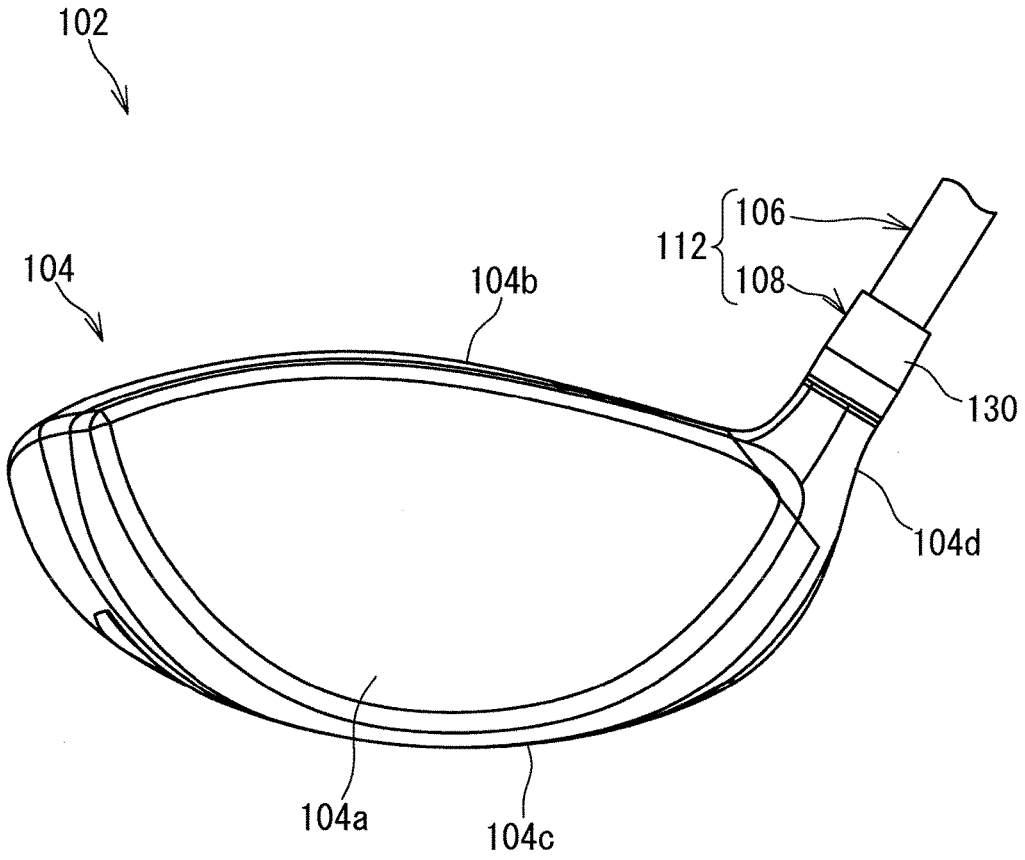
FIG. 12 shows a golf club according to a second embodiment.
Figure 13:
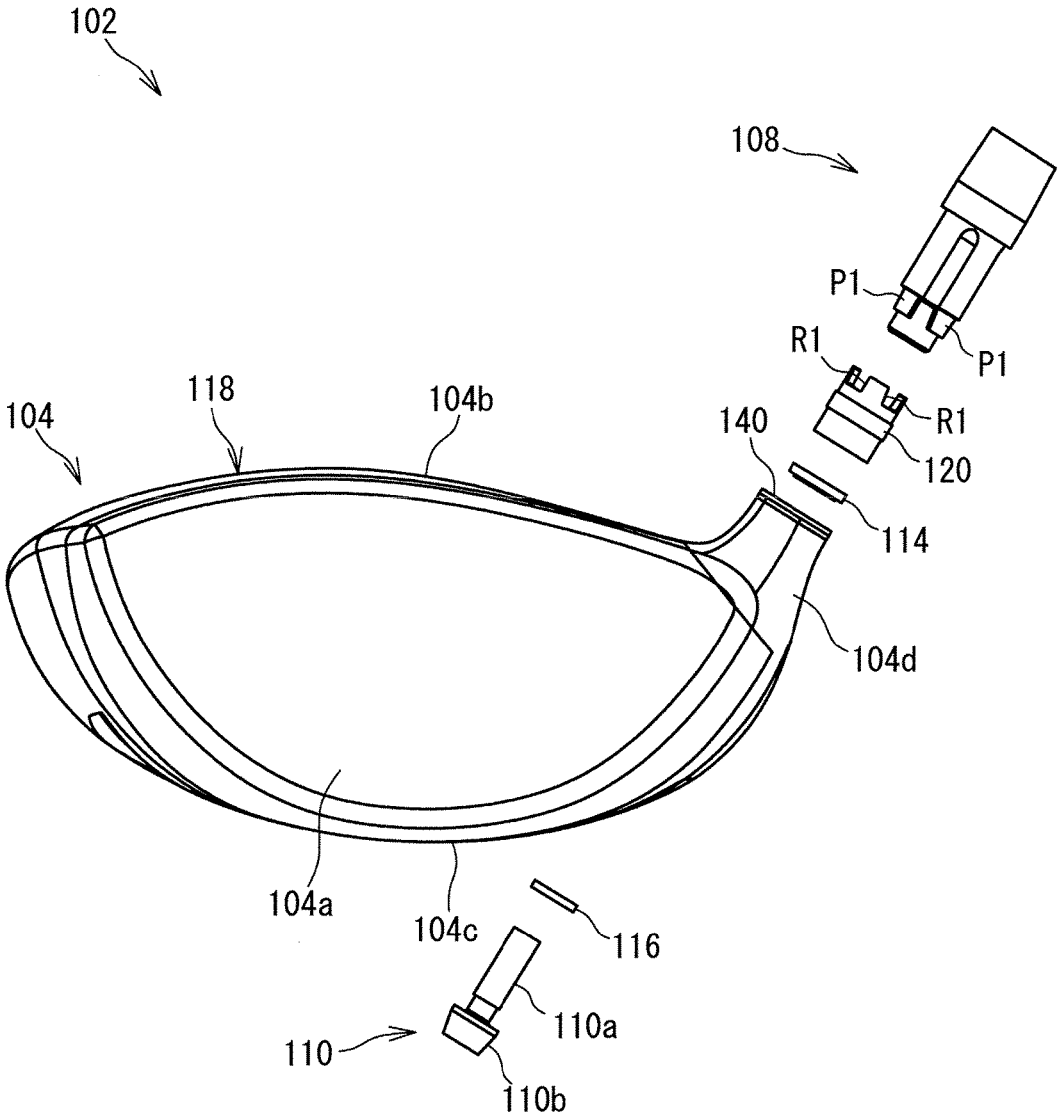
FIG. 13 is an exploded view of the golf club in FIG. 12.
Figure 14:
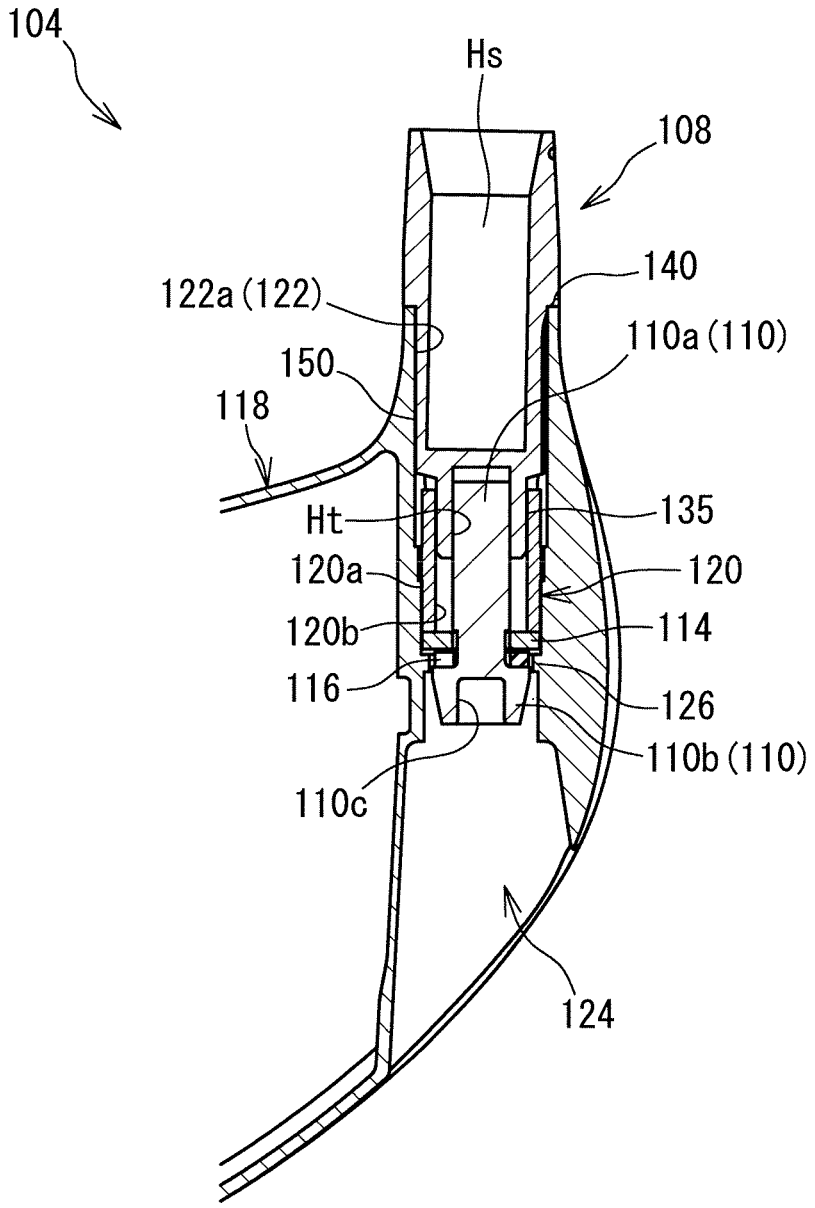
FIG. 14 is a sectional view of the golf club in FIG. 12.

FIG. 12 is a front view of a golf club 102 according to a second embodiment. FIG. 12 shows only the vicinity of a head of the golf club 102. FIG. 13 is an exploded view of the golf club 102. A shaft and a grip are not shown in FIG. 13. FIG. 14 is a sectional view of the golf club 102. FIG. 14 is a sectional view taken along a center line of a sleeve 108.

The golf club 102 has a head 104, a shaft 106, the sleeve 108, and a screw 110. As shown in FIG. 13, the golf club 102 further has an intermediate member 114 and a washer 116.

The head 104 has a face 104*a*, a crown 104*b*, a sole 104*c*, and a hosel 104*d*.

The head 104 is a wood type head. The head 104 is a driver head. The type of the head 104 is not limited in the present disclosure. Examples of the head 104 include a wood type head, a utility type head, a hybrid type head, an iron type head, and a putter head. The shaft 106 is not limited, and a carbon shaft, a steel shaft, etc. which have been generally used may be used.

The sleeve 108 is fixed to a tip end portion of the shaft 106. A grip which is not shown in the drawings is attached to a butt end portion of the shaft 106. The shaft 106 and the sleeve 108 are fixed to each other to form a shaft 112 with the sleeve.

The screw 110 has a male screw part 110*a* and a head part 110*b*. The male screw part 110*a* can be screw-connected to a screw hole Ht of the sleeve 108. The head part 110*b* has a recess part 110*c* which receives a tool. In FIG. 13 and FIG. 14, a male screw of the male screw part 110*a* is not depicted.

The sleeve 108 (shaft 112 with the sleeve) is fixed to the head 104 by tightening the screw 110 thereby to achieve the connected state. FIG. 14 is a sectional view in the connected state. The fixation between the head 104 and the shaft 112 with the sleeve is released by loosening the screw 110 thereby to achieve the separated state. The shaft 106 is detachably attached to the head 104.

The intermediate member 114 is a ring-shaped member. The outer surface of the intermediate member 114 is a circumferential surface. Although not shown in the drawings, the inner surface of the intermediate member 114 forms a female screw. The intermediate member 114 has a function of preventing the screw 110 from falling off. This function is detailed later.

Needless to say, the intermediate member 114 may not be present. When a falling-off prevention function for the screw 110 is unnecessary, the intermediate member 114 is also unnecessary. Even if a falling-off prevention function for the screw 110 is required, the intermediate member 114 might be unnecessary. For example, a head body 118 may have a flange having the same shape as the shape of the intermediate member 114. An O-ring may be used instead of the intermediate member 114. A falling-off prevention function can be fulfilled by setting the inner diameter of the O-ring such that the male screw part 110*a* of the screw 110 is inserted into and retained by the O-ring.

As shown in FIG. 13 and FIG. 14, the head 104 has the head body 118 and an engaging member 120.

FIG. 14 is a sectional view of the head body 118.

Figure 15:
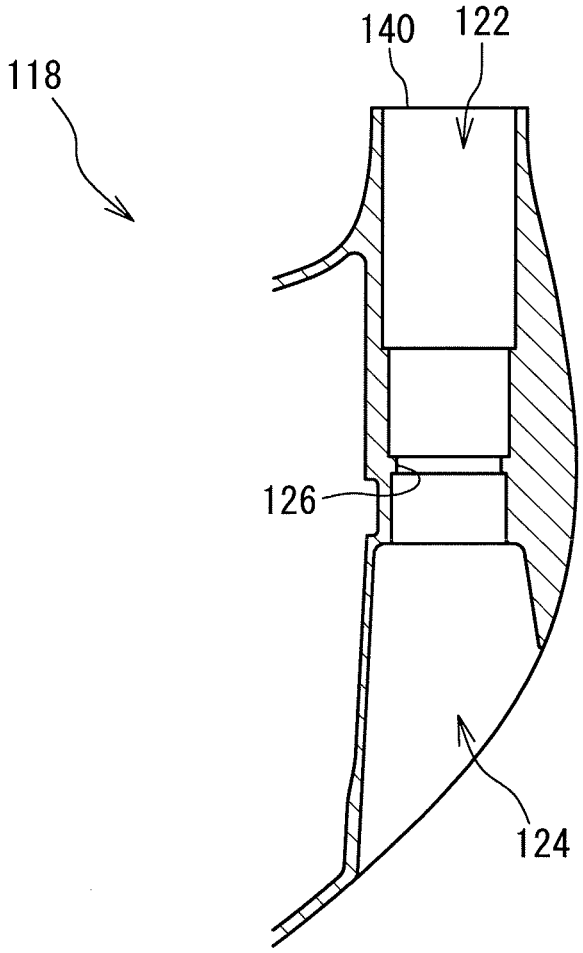
FIG. 15 is a sectional view of a head body according to the second embodiment.

The head body 118 has a hosel hole 122 (see FIG. 14 and FIG. 15). The sleeve 108 is inserted to the hosel hole 122. The head body 118 has a through-hole 124 to which the screw 110 is inserted. The through-hole 124 penetrates through a bottom part of the hosel hole 122 to reach the sole. The through-hole 124 is opened toward the lower side. The head body 118 has a hollow part.

As shown in FIG. 15, the head body 118 has a flange 126. In the connected state, the flange 126 is located on the lower side of the sleeve 108. As shown in FIG. 14, the inner diameter of the flange 126 is greater than the outer diameter of the washer 116. As shown in FIG. 14, the outer diameter of the intermediate member 114 is greater than the inner diameter of the flange 126.

As shown in FIG. 13 and FIG. 14, the engaging member 120 has an outer surface 120*a* and an inner surface 120*b*. The outer surface 120*a* is a circumferential surface. The outer surface 120*a* has a shape corresponding to a shape of the hosel hole 122 at a position where the engaging member 120 is fixed to the hosel hole 122. The inner surface 120*b* is a circumferential surface. The inner diameter of the circumferential surface 120*b* corresponds to the outer diameter of a circumferential outer surface 135 provided on a lower part 134 (described later) of the sleeve 108. The engaging member 120 is fixed to the head body 118.

As shown in FIG. 13, the engaging member 120 has an engaging recess part R1. The engaging recess part R1 is formed on an upper end surface of the engaging member 120. The engaging member 120 is fixed to the head body 118 to form the engaging recess part R1 in the head 104.

Needless to say, the engaging member 120 may not be present. For example, the engaging member 120 may be integrated with the head body 118. In other words, the head body 118 may have a shape equivalent to the engaging member 120.

Figure 16:
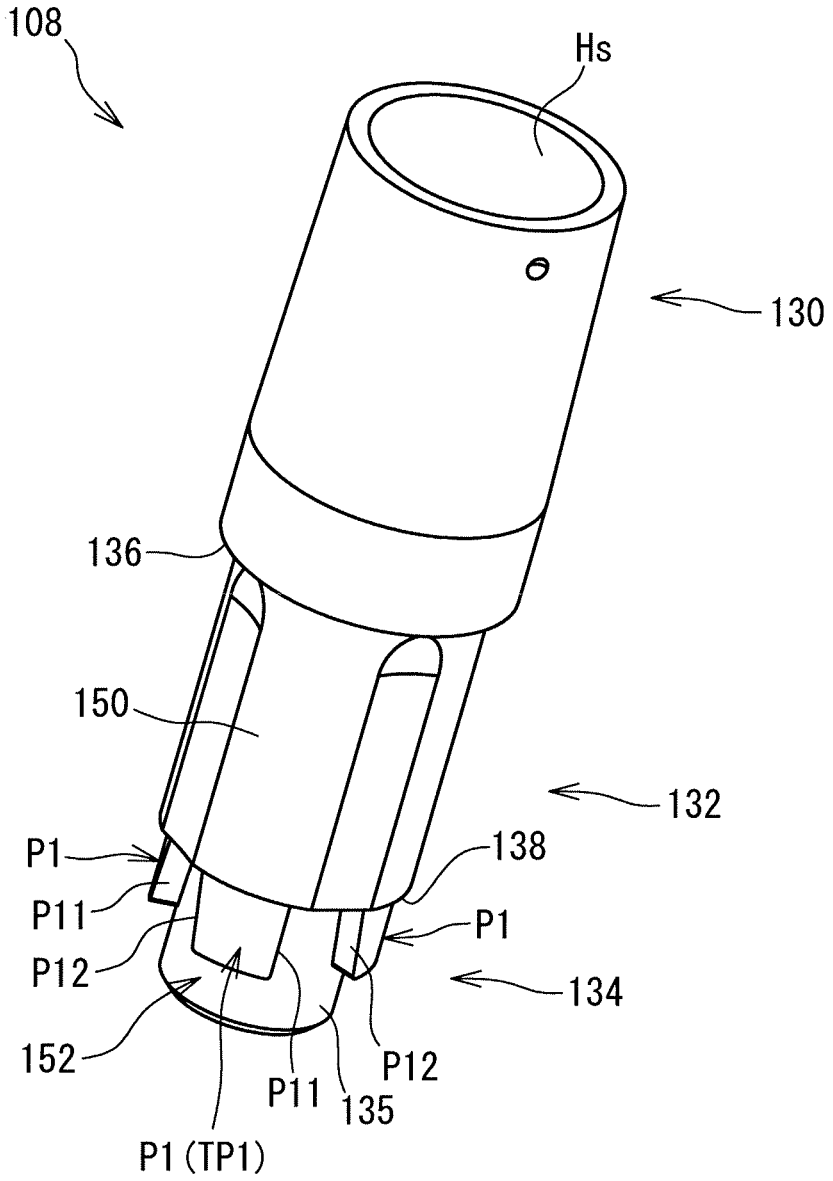
FIG. 16 is a perspective view of a sleeve according to the second embodiment.
Figure 17:
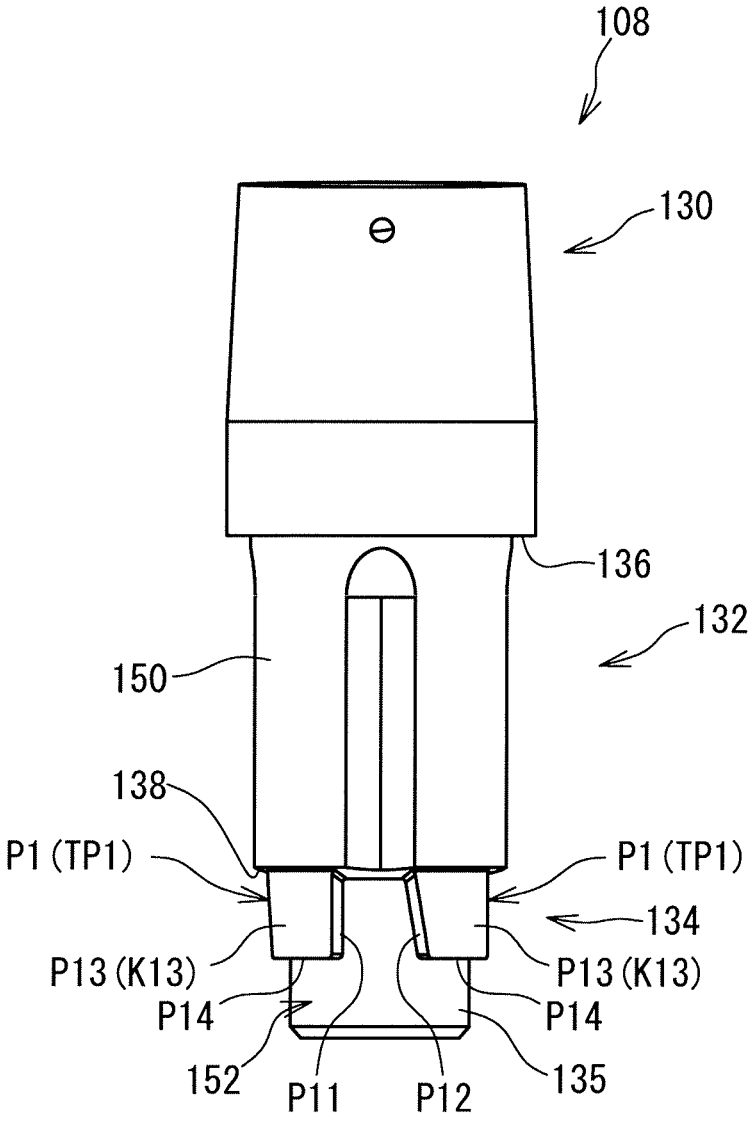
FIG. 17 is a side view of the sleeve in FIG. 16.
Figure 18:
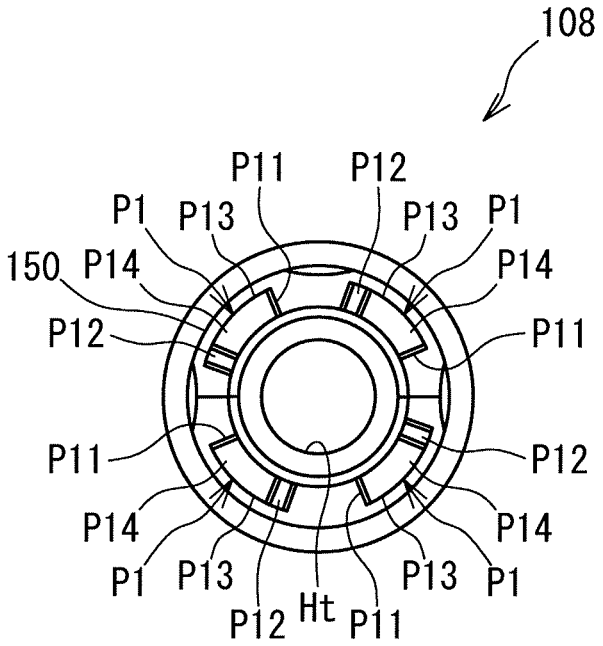
FIG. 18 is a bottom view of the sleeve in FIG. 16.
Figure 19:
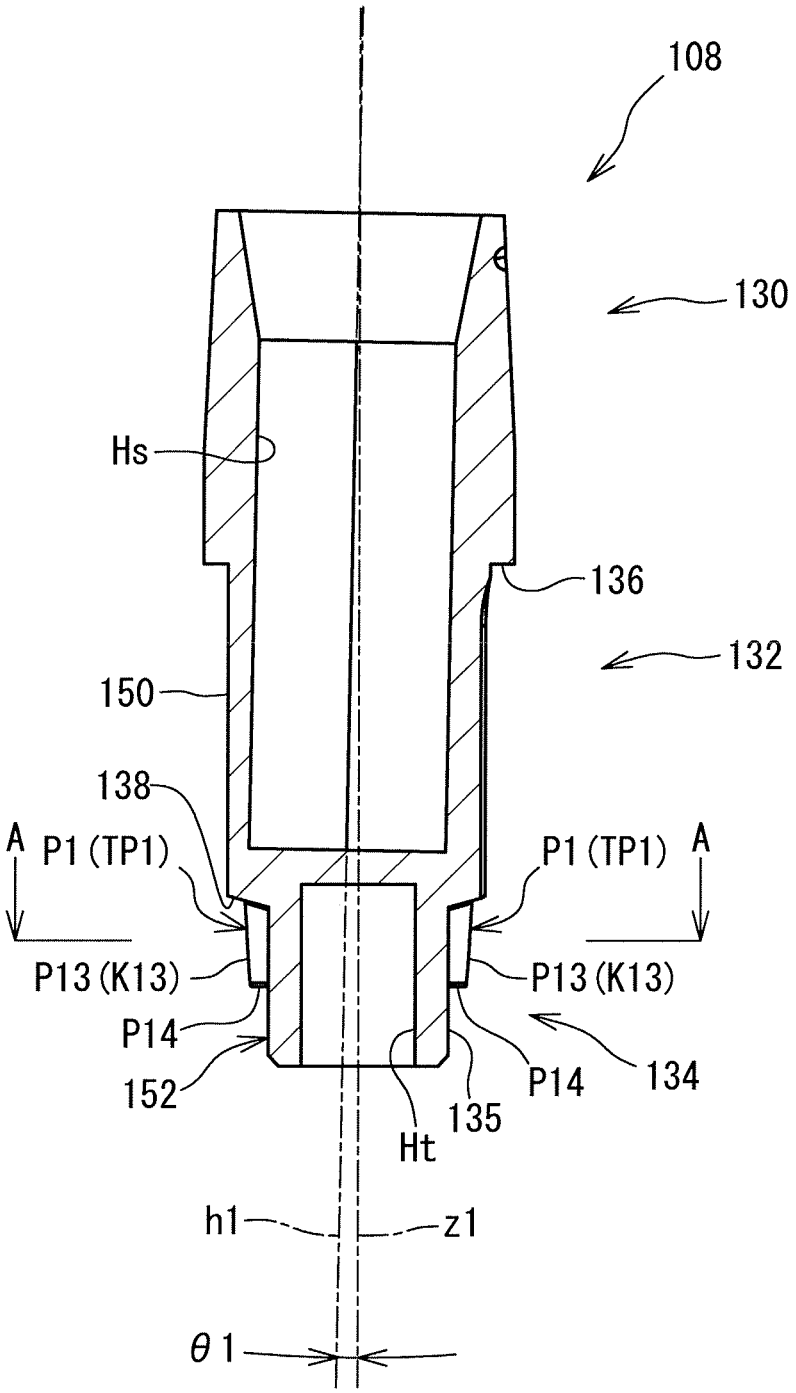
FIG. 19 is a sectional view of the sleeve in FIG. 16.
Figure 20:
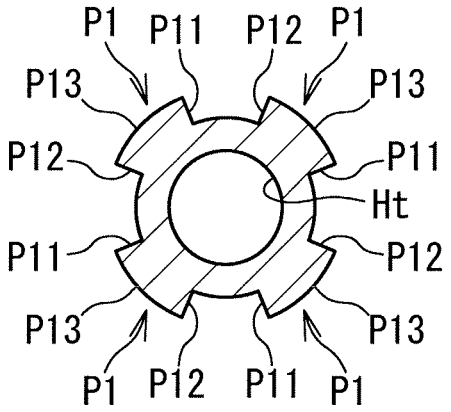
FIG. 20 is a sectional view taken along line A-A in FIG. 19.
Figure 21:
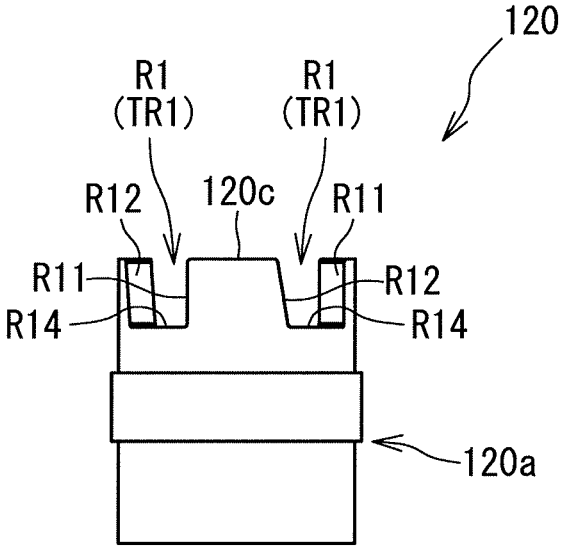
FIG. 21 is a side view of an engaging member according to the second embodiment.
Figure 22:
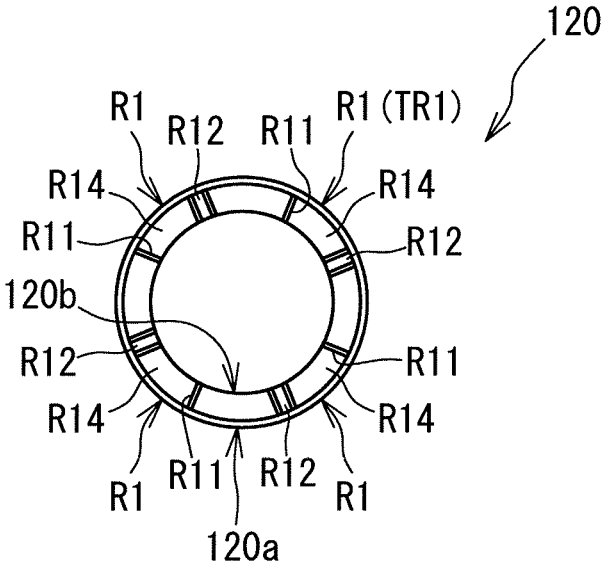
FIG. 22 is a plan view of the engaging member in FIG. 21.

FIG. 16 is a perspective view of the sleeve 108. FIG. 17 is a side view of the sleeve 108. FIG. 18 is a bottom view of the sleeve 108. FIG. 19 is a sectional view of the sleeve 108. FIG. 20 is a sectional view taken along line A-A in FIG. 19. FIG. 21 is a side view of the engaging member 120. FIG. 22 is a plan view of the engaging member 120.

The sleeve 108 has an upper part 130, a middle part 132, and the lower part 134. A step surface 136 is present on a boundary between the upper part 130 and the middle part 132. A step surface 138 is present on a boundary between the middle part 132 and the lower part 134.

The sleeve 108 has a shaft hole Hs and the screw hole Ht. The shaft hole Hs is located inside the upper part 130 and the middle part 132. The shaft hole Hs is opened toward one side (upper side) of the sleeve 108. The screw hole Ht is opened toward the other side (lower side) of the sleeve 108. The screw hole Ht is located inside the lower part 134.

In the connected state, the upper part 130 is exposed (see FIG. 12). In the connected state, the step surface 136 does not abut on a hosel end surface 140 of the head 104. A (slight) gap is present between the step surface 136 and the hosel end surface 140.

As shown in FIG. 12, the outer diameter of a lower end of the upper part 130 is substantially equal to the outer diameter of the hosel end surface 140. In the connected state, the upper part 130 has an appearance like a ferrule. In the connected state, the middle part 132 and the lower part 134 are located inside the hosel hole 122.

The outer surface of the middle part 132 of the sleeve 108 has a circumferential surface 150. In the connected state, the circumferential surface 150 is brought into contact with the hosel hole 122. The circumferential surface 150 is brought into surface-contact with a circumferential surface 122*a* of the hosel hole 122. This contact contributes to holding of the sleeve 108.

As well shown in FIG. 16 and FIG. 17, the sleeve 108 has an engaging projection part P1. The engaging projection part P1 is provided on the lower part 134 of the sleeve 108. The outer surface of the lower part 134 has a circumferential outer surface 135. The circumferential outer surface 135 is brought into contact with the inner surface 120*b* of the engaging member 120 (FIG. 14). The lower part 134 of the sleeve 108 has a screw-hole containing part 152. The screw-hole containing part 152 includes the screw hole Ht. In FIG. 19, a female screw in the screw hole Ht is not depicted.

As shown in FIG. 19, a center line h1 of the shaft hole Hs is inclined with respect to a center line z1 of the outer surface (circumferential surface 150) of the sleeve 108. An inclination angle θ1 shown in FIG. 19 is an angle between the center line h1 and the center line z1. In the connected state, the center line z1 is equal to the center line of the hosel hole 122. The center line h1 of the shaft hole Hs is equal to the center line of the shaft 106. A loft angle, a lie angle, and a face angle can be adjusted by the inclination angle θ1.

The sleeve 108 has the engaging projection part P1. The engaging projection part P1 is provided on an outer circumferential surface of the sleeve 108. The engaging projection part P1 is provided on the circumferential surface 135. The engaging projection part P1 is provided on the lower part 134. The engaging projection part P1 is provided at an upper end of the lower part 134. An upper end of the engaging projection part P1 is located at the step surface 138.

A plurality of engaging projection parts P1 are provided on the sleeve 108. As well shown in FIG. 18, the plurality of engaging projection parts P1 are arranged at equal intervals in the circumferential direction. The engaging projection parts P1 are arranged at intervals of a predetermined angle in the circumferential direction. In the present embodiment, four engaging projection parts P1 are provided. The engaging projection parts P1 are arranged at 90-degree intervals in the circumferential direction. The plurality of (four) engaging projection parts P1 have the same shape. The plurality of engaging projection parts P1 are varied only in their circumferential-direction positions.

As shown in FIG. 21, the engaging recess part R1 is formed toward the lower side from an upper end surface 120*c* of the engaging member 120. In the engaging member 120, the engaging recess part R1 is formed as a cutout. The engaging member 120 is fixed inside the hosel hole 122. As a result, the engaging recess part R1 is formed inside (on the inner surface of) the hosel hole 122.

In the engaging member 120, a plurality of engaging recess parts R1 are provided. As well shown in FIG. 22, the plurality of engaging recess parts R1 are arranged at equal intervals in the circumferential direction. The engaging recess parts R1 are arranged at intervals of a predetermined angle in the circumferential direction. In the present embodiment, four engaging recess parts R1 are provided. The engaging recess parts R1 are arranged at 90-degree intervals in the circumferential direction. The plurality of (four) engaging recess parts R1 have the same shape. The plurality of engaging recess parts R1 are varied only in their circumferential-direction positions.

As shown in FIG. 14, the engaging member 120 is fixed to (a lower part of) the hosel hole 122. The engaging member 120 is located on a lower side relative to the hosel end surface 140. The engaging member 120 is located on a lower side relative to the circumferential surface 122*a* of the hosel hole 122. Fixation of the engaging member 120 can be attained by adhesion, welding, etc.

In the connected state, the lower part 134 of the sleeve 108 is inserted to the engaging member 120 (FIG. 14). The inner surface 120*b* of the engaging member 120 is brought into contact with the circumferential surface 135 of the sleeve 108. The engaging member 120 holds the lower part 134.

Furthermore, in the connected state, the engaging projection parts P1 of the sleeve 108 are engaged with the engaging recess parts R1 of the engaging member 120. The engaging projection parts P1 are engaged with the respective engaging recess parts R1. A rotation of the sleeve 108 with respect to the head 104 is regulated by the engagement.

As shown in FIG. 14, the intermediate member 114 is located between the engaging member 120 and the flange 126. An axial-direction distance between the engaging member 120 and the flange 126 is greater than an axial-direction length of the intermediate member 114. The intermediate member 114 is not fixed to the hosel hole 122. The intermediate member 114 can move between the engaging member 120 and the flange 126.

In the connected state shown in FIG. 14, an axial force caused by tightening the screw 110 is transmitted to the engaging member 120 through the washer 116 and the intermediate member 114. The engaging member 120 receives the upward axial force.

The intermediate member 114 prevents the screw 110 in the separated state from falling off. In the connected state shown in FIG. 14, the screw 110 is tightened. The screw 110 moves toward the lower side with respect to the sleeve 108 as the screw 110 is loosened. When the screw 110 is further loosened, the male screw part 110*a* of the screw 110 reaches the intermediate member 114. As above mentioned, the inner surface of the intermediate member 114 is a female screw. The female screw conforms to the male screw part 110*a*. When the screw 110 is further loosened, the male screw part 110*a* is screw-connected to the intermediate member 114. When the male screw part 110*a* comes out of the screw hole Ht, the male screw part 110*a* is screw-connected to the intermediate member 114. Even when the male screw part 110*a* is come out of the screw hole Ht and the shaft 112 with the sleeve is detached from the head 104, the screw 110 which is screw-connected to the intermediate member 114 does not fall off from the head 104. Since the screw 110 is held by the head 104, re-connection can be performed smoothly. In addition, the loss of the screw 110 is prevented.

[Details of the Engaging Projection Parts P1 and the Engaging Recess Parts R1]

In the above-described first and second embodiments, regulation of falling off (axial-direction movement) of the sleeve with respect to the head is attained by connection between the sleeve and the screw. Regulation of rotation of the sleeve with respect to the head is attained by the engagement between the engaging projection parts P1 and the respective engaging recess parts R1.

Hereinafter, the engaging projection parts P1 and the engaging recess parts R1 in these embodiments are explained in detail.

[Engaging Projection Parts P1 of the First Embodiment]

As shown in FIG. 8, in the first embodiment, each of the engaging projection parts P1 has a first side surface P11, a second side surface P12, and an outer surface P13. The engaging projection part P1 further has a lower edge P14.

The first side surface P11 is a side surface on one side of the engaging projection part P1. The second side surface P12 is a side surface on the other side of the engaging projection part P1.

A rotating force (relative rotating force) acts between the sleeve 8 and the hosel hole 22 in hitting. A hitting point is located apart from the axis line of the shaft. Therefore, a force which the face receives from a ball at the hitting point produces a rotation moment about the axis line of the shaft. The rotation moment produces the rotating force.

The rotating force acts between the engaging projection part P1 and the corresponding engaging recess part R1. Of the two side surfaces in the engaging projection part P1, the rotating force acts on the first side surface P11. The first side surface P11 make a greater contribution to the regulation of the rotation as compared with the second side surface P12.

Thus, the first side surface P11 is a side surface located on a side which receives the rotating force caused by hitting. The second side surface P12 is a side surface located on an opposite side to the first side surface P11. In a specific engaging projection part P1, the first side surface P11 is a side surface located on an opposite side to the rotating direction of the head (see FIG. 11).

The head 4 is right-handed. For this reason, when the head 4 is viewed from the upper side (grip side), the head 4 is rotated in a clockwise direction with respect to the sleeve 8. As a result, when the sleeve 8 is viewed from the upper side (see FIG. 11), in a specific engaging projection part P1, the first side surface P11 is located on a counter-clockwise side with respect to the second side surface P12. In FIG. 9, the sleeve 8 is viewed from the lower side. For this reason, the first side surface P11 is located on the clockwise side with respect to the second side surface P12.

A two-dot chain line in FIG. 8 shows an extending direction of the first side surface P11. As shown in FIG. 8, the first side surface P11 extends along the axial direction. The first side surface P11 is parallel to the axial direction. However, the first side surface P11 gets closer to the second side surface P12 as approaching to the tip end of the sleeve 8. This is because the second side surface P12 is inclined with respect to the axial direction.

As shown in FIG. 8, the second side surface P12 is inclined so as to go toward the middle side of the engaging projection part P1 as approaching to the tip end of the sleeve 8. The second side surface P12 is inclined so as to go toward the first side surface P11 as approaching to the tip end of the sleeve 8.

In light of easy explanation, directions of inclinations (a plus direction and a minus direction) are defined. In the first side surface P11 and a first opposed surface R11, an inclination by which a reaction force caused by the rotating force acts in an engagement releasing direction is defined as a plus-direction inclination. An inclination in an opposite direction to the plus-direction inclination is defined as a minus-direction inclination. In the first side surface P11 and the first opposed surface R11, an inclination by which the reaction force caused by the rotating force acts in an engaging direction is the minus-direction inclination.

In the present application, the "engagement releasing direction" means a direction in which the engaging projection part P1 is extracted from the engaging recess part R1, and the "engaging direction" in the present application means a direction in which the engaging projection part P1 is inserted to (engaged with) the engaging recess part R1.

In a right-handed golf club as in the present embodiment, as viewed from the upper side (grip side), an inclination inclined so as to go toward the clockwise direction as approaching to the tip end of the sleeve 8 is the plus-direction inclination. As viewed from the upper side, an inclination inclined so as to go toward the counter-clockwise direction as approaching to the tip end of the sleeve 8 is the minus-direction inclination. In a left-handed golf club, as viewed from the upper side, an inclination inclined so as to go toward the counter-clockwise direction as approaching to the tip end of the sleeve 8 is the plus-direction inclination. As viewed from the upper side, an inclination inclined so as to go toward the clockwise direction as approaching to the tip end of the sleeve 8 is the minus-direction inclination.

As shown in FIG. 8, the first side surface P11 of the sleeve 8 is not inclined in the plus direction nor inclined in the minus direction. The second side surface P12 of the sleeve 8 is inclined in the minus direction.

A distance between the first side surface P11 and the second side surface P12 is decreased toward the tip end of the sleeve 8. By the structure, a tapered projection part TP1 is formed on the engaging projection part P1.

As shown in FIG. 8 and FIG. 9, the outer surface P13 extends between the first side surface P11 and the second side surface P12. As shown in FIG. 9, the outer surface P13 is a circumferential surface. As shown in FIG. 8, the outer surface P13 has an outer inclination surface K13 inclined so as to go toward a radial-direction inner side as approaching to the tip end of the sleeve 8. In the present embodiment, the whole outer surface P13 is the outer inclination surface K13. The outer surface P13 is a conical projection surface. At the lower edge P14, a height of the engaging projection part P1 is zero.

[Engaging Recess Parts R1 of the First Embodiment]

In the first embodiment, each of the engaging recess parts R1 has the first opposed surface R11, a second opposed surface R12, and an inner surface R13. The engaging recess part R1 further has a lower edge R14 (see FIG. 4, FIG. 5, and FIG. 6).

The first opposed surface R11 is a side surface on one side of the engaging recess part R1. The second opposed surface R12 is a side surface on the other side of the engaging recess part R1.

In the connected state, the first opposed surface R11 is a surface opposed to the first side surface P11. The first opposed surface R11 is brought into contact with the first side surface P11. The contact may be surface-contact, may be line-contact, or may be point-contact.

In the connected state, the second opposed surface R12 is a surface opposed to the second side surface P12. The second opposed surface R12 is brought into contact with the second side surface P12. The contact may be surface-contact, may be line-contact, or may be point-contact.

The above-mentioned rotating force is transmitted to the first side surface P11 from the first opposed surface R11. The first side surface P11 receives the rotating force. The rotating force is offset between the first side surface P11 and the first opposed surface R11. The rotation of the sleeve 8 is prevented by the engagement between the first opposed surface R11 and the first side surface P11.

Thus, of the two side surfaces P11 and P12, the first side surface P11 is located on a side which receives the rotating force caused by hitting. The first opposed surface R11 is opposed to the first side surface P11.

The head 4 is right-handed. For this reason, when the head 4 is viewed from the upper side (grip side), the head 4 is rotated in the clockwise direction with respect to the sleeve 8. As a result, when the hosel hole 22 is viewed from the upper side (see FIG. 5), in a specific engaging recess part R1, the first opposed surface R11 is located on the counter-clockwise side with respect to the second opposed surface R12.

A two-dot chain line in FIG. 6 shows an extending direction of the first opposed surface R11. As shown in FIG. 6, the first opposed surface R11 extends along the axial direction. The first opposed surface R11 is parallel to the axial direction. However, the first opposed surface R11 gets closer to the second opposed surface R12 as approaching to the tip end of the sleeve 8.

As shown in FIG. 6, the second opposed surface R12 is inclined so as to go toward the middle side of the engaging recess part R1 as approaching to the tip end of the sleeve 8. The second opposed surface R12 is inclined so as to go toward the first opposed surface R11 as approaching to the tip end of the sleeve 8. The first opposed surface R11 of the sleeve 8 is not inclined in the plus direction nor inclined in the minus direction. The second opposed surface R12 of the sleeve 8 is inclined in the minus direction.

A distance between the first opposed surface R11 and the second opposed surface R12 is decreased toward the tip end of the sleeve 8. In other words, the distance between the first opposed surface R11 and the second opposed surface R12 is decreased as going to the lower side. By this structure, a tapered recess part TR1 is formed on the engaging recess part R1.

In the connected state, the inner surface R13 is a surface opposed to the outer surface P13 (see FIG. 3). The inner surface R13 is brought into contact with the outer surface P13. The contact may be surface-contact, may be line-contact, or may be point-contact. In the embodiment of FIG. 3, the contact between the inner surface R13 and the outer surface P13 is surface-contact.

As shown in FIG. 4, FIG. 5, and FIG. 6, the inner surface R13 extends between the first opposed surface R11 and the second opposed surface R12. As shown in FIG. 5, the inner surface R13 is a circumferential surface. As shown in FIG. 3, the inner surface R13 has an inner inclination surface J13 inclined so as to go toward the radial-direction inner side as approaching to the tip end of the sleeve 8. The inner inclination surface J13 is inclined so as to go toward the radial-direction inner side as going to the lower side. In the present embodiment, the whole inner surface R13 is the inner inclination surface J13. The inner surface R13 is a conical recess surface. At the lower edge R14, a depth of the engaging recess part R1 is zero.

[Engaging Projection Parts P1 of the Second Embodiment]

In the second embodiment, although positions of the engaging projection parts P1 and the engaging recess parts R1 are different from those of the first embodiment, the shapes and functions of the engaging recess parts R1 and the engaging projection parts P1 are the same as those of the first embodiment.

As shown in FIG. 17, in the second embodiment, each of the engaging projection parts P1 has a first side surface P11, a second side surface P12, and an outer surface P13. The engaging projection part P1 further has a lower edge P14.

The first side surface P11 is a side surface on one side of the engaging projection part P1. The second side surface P12 is a side surface on the other side of the engaging projection part P1.

The first side surface P11 is located on a side which receives the rotating force caused by hitting. The second side surface P12 is located on the opposite side to the first side surface P11.

As shown in FIG. 16 and FIG. 17, the first side surface P11 extends along the axial direction. The first side surface P11 is parallel to the axial direction. However, the first side surface P11 gets closer to the second side surface P12 as approaching to the tip end of the sleeve 108.

The second side surface P12 is inclined so as to go toward the middle side of the engaging projection part P1 as approaching to the tip end of the sleeve 108. The second side surface P12 is inclined so as to go toward the first side surface P11 as approaching to the tip end of the sleeve 108.

The first side surface P11 of the sleeve 108 is not inclined in the plus direction nor inclined in the minus direction. The second side surface P12 of the sleeve 108 is inclined in the minus direction.

A distance between the first side surface P11 and the second side surface P12 is decreased toward the tip end of the sleeve 108. A tapered projection part TP1 is formed on the engaging projection part P1 by this structure. In the present embodiment, the whole engaging projection part P1 is the tapered projection part TP1.

The outer surface P13 extends between the first side surface P11 and the second side surface P12. As shown in FIG. 18, the outer surface P13 is a circumferential surface. As shown in FIG. 19, the outer surface P13 has an outer inclination surface K13 inclined so as to go toward the radial-direction inner side as approaching to the tip end of the sleeve 108. In the present embodiment, the whole outer surface P13 is the outer inclination surface K13. The outer surface P13 is a conical projection surface. A height of the engaging projection part P1 at the lower edge P14 is not zero.

[The Engaging Recess Parts R1 of the Second Embodiment]

In the second embodiment, the engaging recess parts R1 are formed by forming recess parts on a member (the engaging member 120) that is separately formed from a head body, and fixing the member to the head body. The engaging recess parts R1 are formed inside the hosel hole. The engaging recess parts R1 are formed below the hosel end surface.

As shown in FIG. 21 and FIG. 22, in the second embodiment, each of the engaging recess parts R1 has a first opposed surface R11 and a second opposed surface R12. The engaging recess part R1 further has a lower edge (bottom surface) R14.

The first opposed surface R11 is a side surface on one side of the engaging recess part R1. The second opposed surface R12 is a side surface on the other side of the engaging recess part R1.

In the connected state, the first opposed surface R11 is a surface opposed to the first side surface P11. The first opposed surface R11 is brought into contact with the first side surface P11. The contact may be surface-contact, may be line-contact, or may be point-contact.

In the connected state, the second opposed surface R12 is a surface opposed to the second side surface P12. The second opposed surface R12 is brought into contact with the second side surface P12. The contact may be surface-contact, may be line-contact, or may be point-contact.

The above-mentioned rotating force is transmitted to the first side surface P11 from the first opposed surface R11. The first side surface P11 receives the rotating force. The rotating force is offset between the first side surface P11 and the first opposed surface R11. The rotation of the sleeve 108 is prevented by the engagement between the first opposed surface R11 and the first side surface P11.

As shown in FIG. 21, the first opposed surface R11 extends along the axial direction. The first opposed surface R11 is parallel to the axial direction. However, the first opposed surface R11 gets closer to the second opposed surface R12 as approaching to the tip end of the sleeve 108.

As shown in FIG. 21, the second opposed surface R12 is inclined so as to go toward the middle side of the engaging recess part R1 as approaching to the tip end of the sleeve 108. The second opposed surface R12 is inclined so as to go toward the first opposed surface R11 as approaching to the tip end of the sleeve 108.

The first opposed surface R11 of the sleeve 108 is not inclined in the plus direction nor inclined in the minus direction. The second opposed surface R12 of the sleeve 108 is inclined in the minus direction.

The distance between the first opposed surface R11 and the second opposed surface R12 is decreased toward the tip end of the sleeve 108. A tapered recess part TR1 is formed on the engaging recess part R1 by this structure. At the lower edge R14, the engaging recess part R1 includes a bottom surface having a width in the radial direction.

In the second embodiment, inner surfaces R13 are not provided. However, even when an engaging member 120 which includes cutout-shaped engaging recess parts R1 as shown in FIG. 21 is used, it is possible to form inner surfaces R13. For example, of the inner surface of the hosel hole 122 located on a position where the engaging member 120 is fixed, portions which are located between the first opposed surfaces R11 and the respective second opposed surfaces R12 can be used as the inner surfaces R13.

Figure 23:
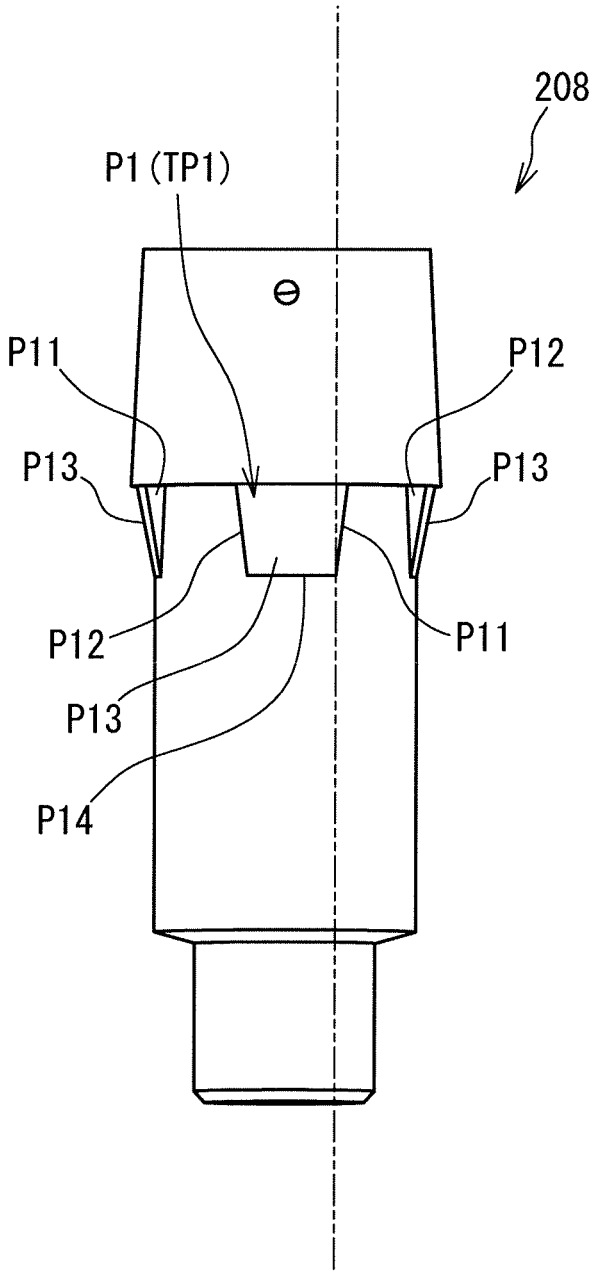
FIG. 23 is a side view of the sleeve according to another embodiment.
Figure 24:
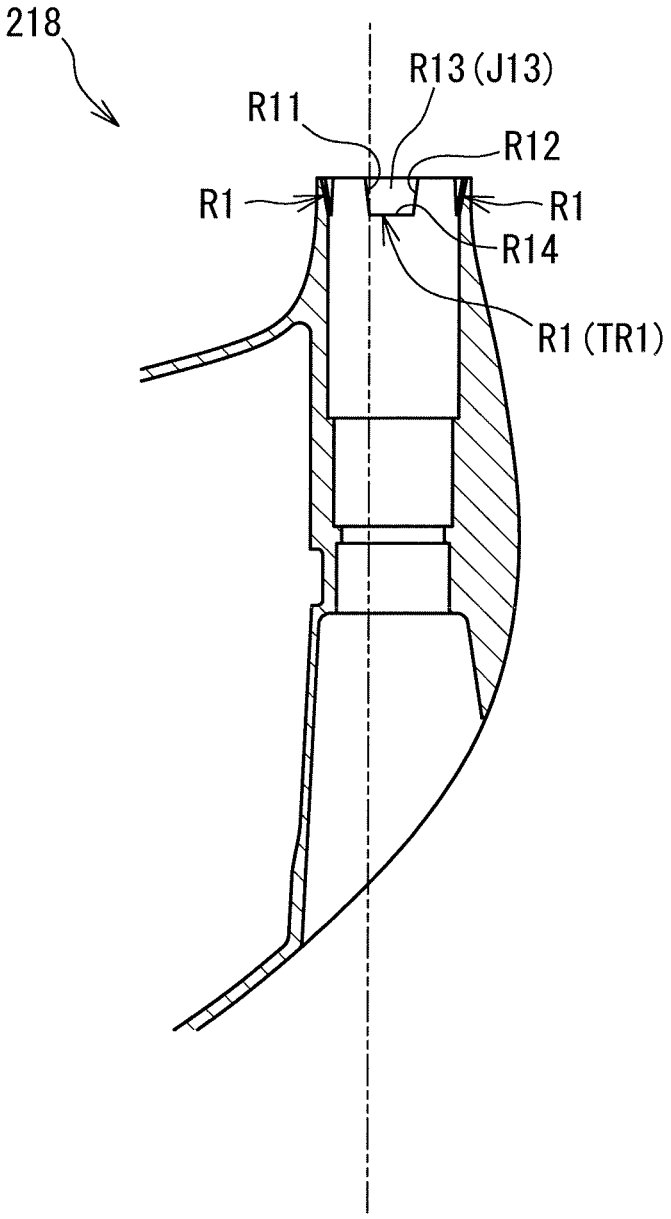
FIG. 24 is a sectional view of a head body according to the embodiment of FIG. 23.

FIG. 23 is a side view of a sleeve 208 which is a modification example. The sleeve 208 is the same as the above-described sleeve 8 except for an angle of the first side surfaces P11. FIG. 24 is a sectional view of a head body 218 suited to the sleeve 208. The head body 218 is the same as the above-described head body 18 except for an angle of the first opposed surfaces R11.

In FIG. 23, the axial direction is shown by a two-dot chain line. In the sleeve 208, each first side surface P11 is inclined with respect to the axial direction. The first side surface P11 is inclined so as to go toward the middle side of the engaging projection part P1 as approaching to the tip end of the sleeve 208. The first side surface P11 is inclined so as to go toward the corresponding second side surface P12 as approaching to the tip end of the sleeve 208. The first side surface P11 is inclined in the plus direction.

Thus, the first side surface P11 may be inclined. There also is an advantageous effect even when a first opposed surface R11 which is parallel to the axial direction is combined with the inclined first side surface P11. This effect is described later.

In FIG. 24, the axial direction is shown by a two-dot chain line. In the head body 218, each first opposed surface R11 is inclined with respect to the axial direction. The first opposed surface R11 is inclined so as to go toward the middle side of the engaging recess part R1 as approaching to the tip end of the sleeve 208. The first opposed surface R11 is inclined so as to go toward the corresponding second opposed surface R12 as approaching to the tip end of the sleeve 208. The first opposed surface R11 is inclined in the plus direction.

Thus, the first opposed surface R11 may be inclined. There also is an advantageous effect even when a first side surface P11 which is parallel to the axial direction is combined with the inclined first opposed surface R11. This effect is described later.

[The Effect of the Engaging Projection Part P1 and the Engaging Recess Part R1]

The engaging projection part P1 and the engaging recess part R1 in the above-described embodiments can fulfill the following advantageous effects.

The rotation of a sleeve with respect to a hosel hole is regulated by the engagement between the engaging recess part R1 and the engaging projection part P1.

The engaging projection part P1 has the tapered projection part TP1. Therefore, the engaging projection part P1 can be entered into the engaging recess part R1 easily. As a result, detaching/attaching of the sleeve (shaft) from/to the head becomes easy, and thus the connected state can be securely attained.

The engaging recess part R1 has the tapered recess part TR1. Therefore, the engaging recess part R1 can accept the engaging projection part P1 easily. As a result, detaching/attaching of the sleeve (shaft) from/to the head becomes easy, and thus the connected state can be securely attained.

[Rotation-Direction Fixing Effect 1]

By inserting the tapered projection part TP1 to the engaging recess part R1, a slight gap (also referred to as a rotation-direction gap) between the first side surface P11 and the first opposed surface R11 can be eliminated. Therefore, a very slight relative rotation between the sleeve and the hosel hole is prevented. In the present application, this effect is also referred to as a rotation-direction fixing effect.

[Rotation-Direction Fixing Effect 2]

By inserting the engaging projection part P1 to the tapered recess part TR1, the rotation-direction gap can be eliminated. Therefore, a very slight relative rotation between the sleeve and the hosel hole is prevented.

[Rotation-Direction Fixing Effect 3]

By inserting the tapered projection part TP1 to the tapered recess part TR1, the synergistic effect of the rotation-direction fixing effect 1 and the rotation-direction fixing effect 2 is fulfilled. For this reason, the rotation-direction gap is further securely eliminated.

[Radial-Direction Fixing Effect 1]

As described above, the outer inclination surface K13 is formed on the outer surface P13 of the engaging projection part P1. By inserting the engaging projection part P1 which has the outer inclination surface K13 to the engaging recess part R1, it becomes possible to eliminate a slight gap (also referred to as a radial-direction gap) between the outer surface P13 and the inner surface R13. Therefore, a slight play in the radial direction between the sleeve and the hosel hole is prevented. In the present application, this effect is also referred to as a radial-direction fixing effect.

[Radial-Direction Fixing Effect 2]

As described above, the inner inclination surface J13 is formed on the inner surface R13 of the engaging recess part R1. By inserting the engaging projection part P1 to the engaging recess part R1 which has the inner inclination surface J13, it becomes possible to eliminate the radial-direction gap. Therefore, the slight play in the radial direction between the sleeve and the hosel hole is prevented.

[Radial-Direction Fixing Effect 3]

The synergistic effect of the radial-direction fixing effect 1 and the radial-direction fixing effect 2 is fulfilled by inserting the engaging projection part P1 which has the outer inclination surface K13 to the engaging recess part R1 which has the inner inclination surface J13. The radial-direction gap is further securely eliminated by the synergistic effect.

Figure 25:
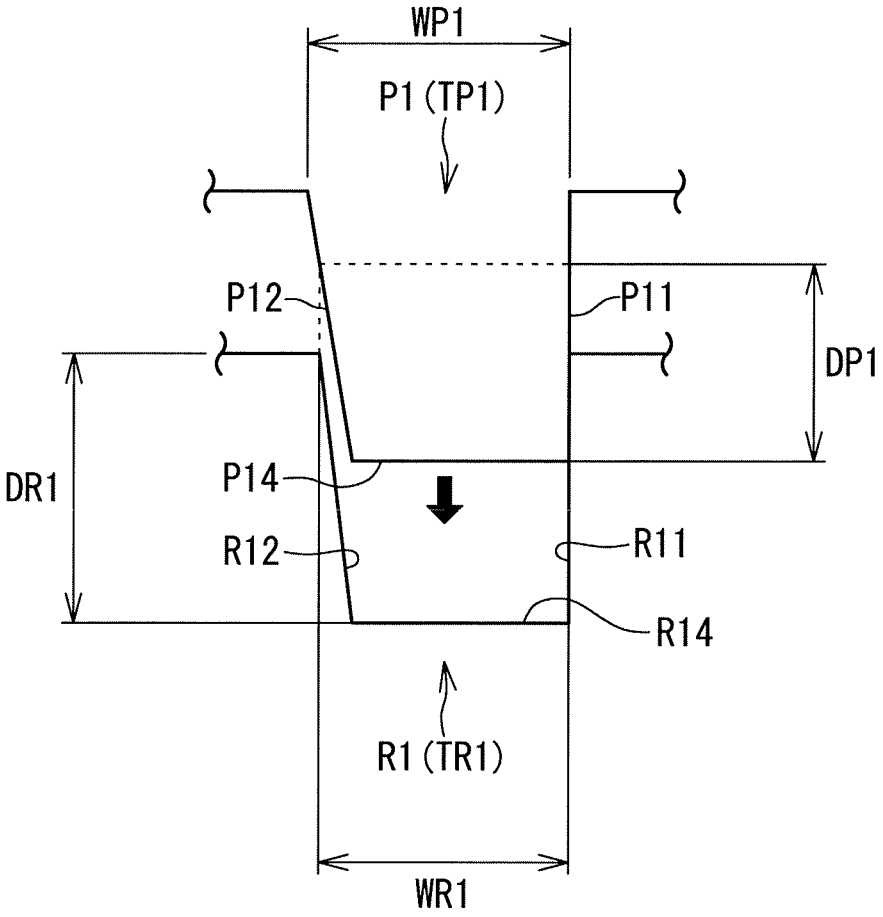
FIG. 25 is a schematic view showing an engaging projection part and an engaging recess part according to another embodiment.

FIG. 25 is a schematic view showing an engaging projection part P1 and an engaging recess part R1 according to a modification example.

A double-pointed arrow WP1 in FIG. 25 shows a maximum width of a tapered projection part TP1. A double-pointed arrow WR1 in FIG. 25 shows an opening width of the engaging recess part R1. The opening width WR1 is the maximum width of a portion, in the engaging recess part R1, which can be engaged with the engaging projection part P1. The opening width WR1 is a width of the upper end of a portion, in the engaging recess part R1, which can be engaged with the engaging projection part P1.

In light of the rotation-direction fixing effect, the maximum width WP1 is preferably equal to or greater than the opening width WR1, and more preferably greater than the opening width WR1. By this structure, the engaging projection part P1 is surely fitted to the engaging recess part R1 thereby to securely eliminate the rotation-direction gap.

In light of the rotation-direction fixing effect, a difference [WP1−WR1] is preferably equal to or greater than 0.05 mm, and more preferably equal to or greater than 0.1 mm. If the difference [WP1−WR1] is excessively great, the gap between the hosel end surface and the step surface of the sleeve becomes large, and appearance can deteriorate. In this respect, the difference [WP1−WR1] is preferably equal to or less than 4.0 mm, and more preferably equal to or less than 2.0 mm.

A double-pointed arrow DP1 in FIG. 25 shows an insertable length of the engaging projection part P1. The length DP1 is an inserted length of the engaging projection part P1 in a state where the engaging projection part P1 is most deeply inserted to the engaging recess part R1. A double-pointed arrow DR1 in FIG. 25 shows an axial-direction depth of the engaging recess part R1.

In light of the rotation-direction fixing effect, the depth DR1 is preferably greater than the length DP1. This structure suppresses deterioration of a contact pressure between the first side surface P11 and the first opposed surface R11, which could be caused by abutment between the lower edge P14 and the lower edge R14. For this reason, the engaging projection part P1 is surely fitted to the engaging recess part R1 thereby to securely eliminate the rotation-direction gap.

In light of eliminating the rotation-direction gap, the following structure (a) is preferable.

(a) In the connected state, a gap is present between the lower edge P14 of the engaging projection part P1 and the lower edge R14 of the engaging recess part R1.

By the structure (a), the engaging projection part P1 is surely fitted to the engaging recess part R1 thereby to securely eliminate the rotation-direction gap.

In light of eliminating the rotation-direction gap and the radial-direction gap, the following structure (b) or structure (c) may be adopted.

(b) In the connected state, the contact between the engaging projection part P1 and the engaging recess part R1 is limited to: a contact between the first side surface P11 and the first opposed surface R11; a contact between the second side surface P12 and the second opposed surface R12; and a contact between the outer surface P13 and the inner surface R13.

(c) In the connected state, the contact between the engaging projection part P1 and the engaging recess part R1 is limited to: a contact between the tapered projection part TP1 and the tapered recess part TR1; and a contact between the outer inclination surface K13 and the inner inclination surface J13.

In light of eliminating the rotation-direction gap, the following structure (d) is preferable.

(d) In the connected state, the axial force of the screw creates the contact pressure between the first side surface P11 and the first opposed surface R11.

In light of eliminating the radial-direction gap, the following structure (e) is preferable.

(e) In the connected state, the axial force of the screw creates a contact pressure between the outer inclination surface K13 and the inner inclination surface J13.

The inventors of the present application have found that a conventional club including a sleeve arouses a strange feeling in hitting. The strange feeling is a feeling (feeling of a twist) as if a twist occurs between the sleeve and the hosel hole. The inventors have found that the strange feeling results from the slight rotation-direction gap and a slight radial-direction gap. By the above-mentioned embodiments, the strange feeling in hitting can be eliminated.

[Axial-Direction Deviation]

The inventors have found that there also is another factor which produces the strange feeling other than the rotation-direction gap and the radial-direction gap.

When the first side surface P11 is an inclination surface having an angle of the plus direction, the reaction force transmitted from the inclination surface acts in the engagement releasing direction. For this reason, the engaging projection part P1 can be moved toward an axial-direction upper side with respect to the engaging recess part R1. This movement is also referred to as an axial-direction deviation. The axial-direction deviation makes the engagement between the engaging recess part R1 and the engaging projection part P1 insecure.

In light of preventing the axial-direction deviation, the following structure (f), (g), or (h) is preferable.

(f) The first side surface P11 extends along the axial direction (see FIG. 8).

(g) The first opposed surface R11 extends along the axial direction (see FIG. 6).

(h) The first side surface P11 extends along the axial direction, and the first opposed surface R11 which abuts on the first side surface P11 extends along the axial direction (see FIG. 25).

A surface which extends along the axial direction does not produce a force acting in the engagement releasing direction. For this reason, the axial-direction deviation can be prevented.

The structure (h) is effective. In the structure (h), the first side surface P11 and the first opposed surface R11 both extending along the axial direction can be brought into surface-contact with each other. Since the surfaces extending along the axial direction are surfaces perpendicular to the rotation direction, the surfaces can surely receive a force in the rotation direction. Since a force acting in the engagement releasing direction does not arise, the axial-direction deviation is prevented.

The structure (f) or (g) can also have a sufficient effect. For example, in the structure (f), a case where the first opposed surface R11 abutting on the first side surface P11 is inclined in the plus direction is considered. In this case, the first opposed surface R11 can produce a force in the engagement releasing direction. However, in this case, the contact between the first side surface P11 and the first opposed surface R11 is point-contact or line-contact, not surface-contact. For this reason, the contact pressure increases to increase frictional force. As a result, sliding between the first side surface P11 and the first opposed surface R11 is suppressed, and the axial-direction deviation is suppressed.

Thus, in light of preventing the axial-direction deviation, the following structure (i) is preferable.

(i) In the connected state, the contact between the first side surface P11 and the first opposed surface R11 is point-contact or line-contact.

In light of attaining the structure (i), the following structure (j) may be adopted.

(j) In the connected state, the first side surface P11 and the first opposed surface R11 are not parallel to each other.

In light of preventing the axial-direction deviation, the following structure (k) or (m) is also preferable.

(k) The first side surface P11 is inclined in the minus direction.

(m) The first opposed surface R11 is inclined in the minus direction.

By the inclination in the minus direction, the rotating force can never act in the engagement releasing direction, to say the least. In addition, when a surface inclined in the minus direction abuts on a surface extending along the axial direction, the way of the contact is to be point-contact or surface-contact. Therefore, the axial-direction deviation is prevented.

Figure 26A:
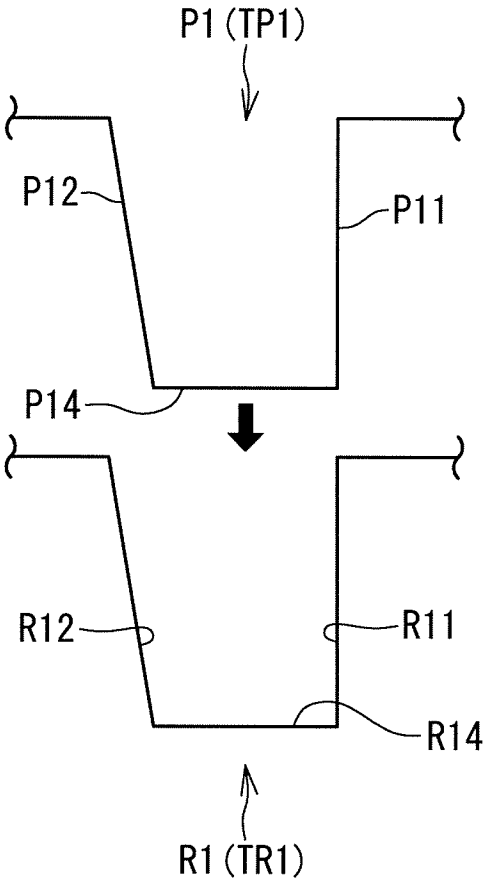
FIG. 26(*a*) is a schematic view showing an engaging projection part and an engaging recess part according to another embodiment.
Figure 26B:
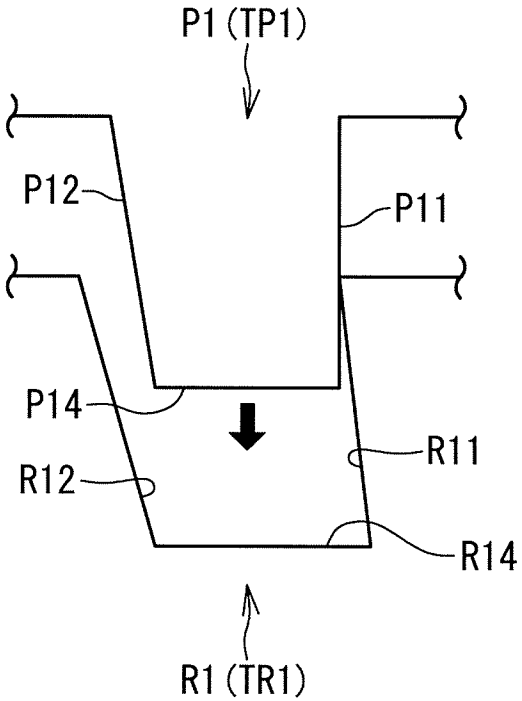
Figure 27B:
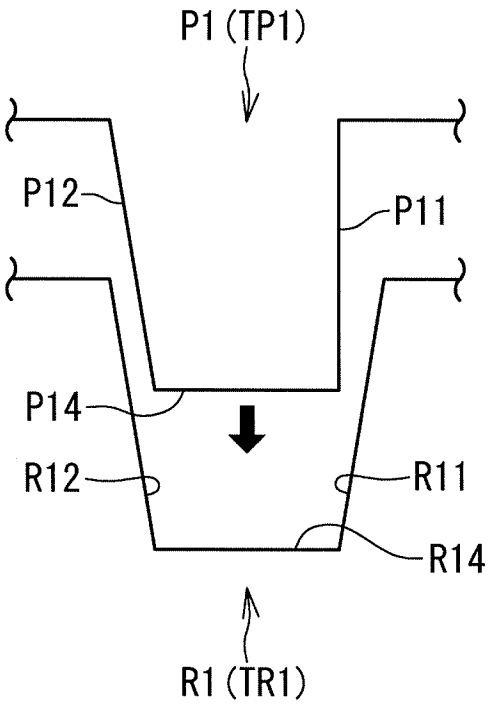
FIG. 27(*a*) is a schematic view showing an engaging projection part and an engaging recess part according to another embodiment.
Figure 27A:
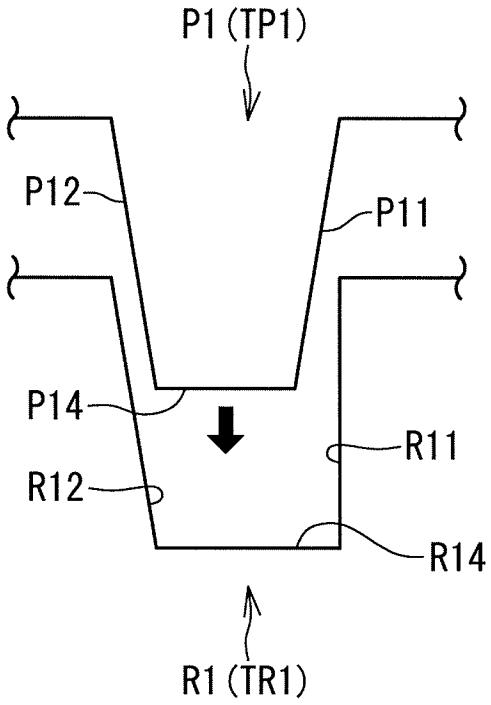

FIG. 26(*a*), FIG. 26(*b*), FIG. 27(*a*) and FIG. 27(*b*) are schematic views showing an engaging projection part P1 and an engaging recess part R1 according to each modification example.

In the embodiment of FIG. 26(*a*), the first side surface P11 extends along the axial direction. The first opposed surface R11 also extends along the axial direction. The second side surface P12 is inclined in the minus direction. The second opposed surface R12 is inclined in the minus direction. The above-described first embodiment and second embodiment are the embodiment of FIG. 26(*a*).

Since the first side surface P11 and the first opposed surface R11 extend along the axial direction, the axial-direction deviation does not arise if the rotating force acts. The rotating force which acts perpendicularly to the axial direction can be surely received by the abutting between the surfaces extending along the axial direction. Therefore, the rotation-direction fixing effect is enhanced.

In the embodiment of FIG. 26(*b*), the first side surface P11 extends along the axial direction. The first opposed surface R11 is inclined in the minus direction. The second side surface P12 is inclined in the minus direction. The second opposed surface R12 is inclined in the minus direction.

The first side surface P11 and the first opposed surface R11 are not parallel to each other. In the connected state, the contact between the first side surface P11 and the first opposed surface R11 is point-contact or line-contact. In the present embodiment, the axial-direction deviation is prevented.

In the embodiment of FIG. 27(*a*), the first opposed surface R11 extends along the axial direction. The first side surface P11 is inclined in the plus direction. The second side surface P12 is inclined in the minus direction. The second opposed surface R12 is inclined in the minus direction.

The first side surface P11 and the first opposed surface R11 are not parallel to each other. In the connected state, the contact between the first side surface P11 and the first opposed surface R11 is point-contact or line-contact. In the present embodiment, the axial-direction deviation is prevented. Although the first side surface P11 is inclined in the plus direction, an increased contact pressure makes frictional force large. For this reason, sliding between the first side surface P11 and the first opposed surface R11 can hardly occur. In the present embodiment, the axial-direction deviation is prevented.

In the embodiment of FIG. 27(*b*), the first side surface P11 extends along the axial direction. The first opposed surface R11 is inclined in the plus direction. The second side surface P12 is inclined in the minus direction. The second opposed surface R12 is inclined in the minus direction. In the connected state, the contact between the first side surface P11 and the first opposed surface R11 is point-contact or line-contact. In the present embodiment, the axial-direction deviation is prevented.

In the present embodiment, the first opposed surface R11 is inclined in the plus direction. However, because of the point-contact or line-contact, the contact pressure is increased and thus the frictional force is large. For this reason, sliding between the first side surface P11 and the first opposed surface R11 can hardly occur. In the present embodiment, the axial-direction deviation is prevented.

The number of the engaging projection parts P1 may be one, and may be two or more. Even when the number is one, the above-described effects such as the rotation-direction fixing effect are fulfilled. When a plurality of engaging projection parts P1 are provided, the engaging projection parts P1 are preferably arranged at equal intervals in the circumferential direction. The number of the engaging recess parts R1 is preferably equal to the number of the engaging projection parts P1.

Examples of the material of the engaging projection part P1 include a metal and a resin. Examples of the metal include a titanium alloy, stainless steel, an aluminum alloy, and a magnesium alloy. In light of strength and lightweight properties, the aluminum alloy and the titanium alloy are preferable. It is preferable that the resin has excellent mechanical strength. For example, the resin is preferably a resin referred to as an engineering plastic or a super-engineering plastic. The sleeve having the engaging projection part P1 can be manufactured by forging, casting, pressing, NC processing, and a combination thereof.

Examples of the material of a portion in which the engaging recess part R1 is formed include a metal and a resin. Examples of the metal include a titanium alloy, stainless steel, an aluminum alloy, and a magnesium alloy. In light of strength and lightweight properties, the aluminum alloy and the titanium alloy are preferable. It is preferable that the resin has excellent mechanical strength. For example, the resin is preferably a resin referred to as an engineering plastic or a super-engineering plastic. The head having the engaging recess part R1 can be manufactured by forging, casting, pressing, NC processing, and a combination thereof. By using an engaging member 120 which is a separated member from a head body as in the second embodiment, processing of the engaging recess part R1 is made easy.

As shown in the above disclosure, advantages of the embodiments are clear.

The golf clubs described above can be applied to all types of golf clubs such as an iron type golf club, a hybrid type golf club, and a wood type golf club.

The above description is merely illustrative example, and various modifications can be made without departing from the principles of the present disclosure.

What is claimed is:

1. A golf club comprising:

a shaft;

a head having a hosel hole;

a sleeve fixed to a tip end portion of the shaft; and a screw capable of being screw-connected to the sleeve, wherein:

the sleeve includes at least one engaging projection part;

the head includes at least one engaging recess part;

a rotation of the sleeve with respect to the hosel hole is regulated based on an engagement between the engaging projection part and the engaging recess part;

a falling-off of the sleeve from the hosel hole is regulated based on a connection between the screw and the sleeve inserted to the hosel hole;

the engaging projection part includes a first side surface located on a side which receives a rotating force caused by hitting, a second side surface located on an opposite side to the first side surface, and an outer surface extending between the first side surface and the second side surface;

the engaging recess part includes a first opposed surface opposed to the first side surface, a second opposed surface opposed to the second side surface, and an inner surface opposed to the outer surface;

the engaging projection part includes a tapered projection part formed such that a distance between the first side surface and the second side surface decreases toward a tip end of the sleeve;

a maximum width of the tapered projection part is equal to or greater than an opening width of the engaging recess part;

at least one of the first side surface and the first opposed surface extends along the axial direction, and the tapered projection part engages the engaging recess part.

2. The golf club according to claim 1, wherein the first side surface and the first opposed surface extend along the axial direction.

3. The golf club according to claim 1, wherein the engaging recess part includes a tapered recess part formed such that a distance between the first opposed surface and the second opposed surface decreases toward the tip end of the sleeve.

4. The golf club according to claim 1, wherein the outer surface includes an outer inclination surface inclined so as to go toward a radial-direction inner side as approaching to the tip end of the sleeve.

5. The golf club according to claim 1, wherein the inner surface includes an inner inclination surface inclined so as to go toward a radial-direction inner side as approaching to the tip end of the sleeve.

6. The golf club according to claim 1, wherein the at least one engaging projection part comprises a plurality of engaging projection parts, the at least one engaging recess part comprises a plurality of engaging recess parts, and the engaging projection parts are engaged with the respective engaging recess parts.

7. The golf club according to claim 6, wherein the engaging projection parts are arranged at equal intervals in a circumferential direction, and the engaging recess parts are arranged at equal intervals in the circumferential direction.

8. The golf club according to claim 1, wherein the engaging recess part is provided on an inner surface of the hosel hole.

9. The golf club according to claim 1, wherein the engaging recess part is provided at an upper end of the hosel hole.

10. The golf club according to claim 1, wherein the head includes a head body and an engaging member formed separately from the head body, the engaging member is fixed inside the hosel hole, and the engaging member has the engaging recess part.

11. The golf club according to claim 1, wherein in a connected state where the sleeve is fixed to the head by tightening the screw, a gap is present between a lower edge of the engaging projection part and a lower edge of the engaging recess part.

12. The golf club according to claim 1, wherein in a connected state where the sleeve is fixed to the head by tightening the screw, a contact pressure between the first side surface and the first opposed surface is produced because of an axial force of the screw.

13. The golf club according to claim 1, wherein the outer surface includes an outer inclination surface inclined so as to go toward a radial-direction inner side as approaching to the tip end of the sleeve;

the inner surface includes an inner inclination surface inclined so as to go toward the radial-direction inner side as approaching to the tip end of the sleeve; and in a connected state where the sleeve is fixed to the head by tightening the screw, a contact pressure between the outer inclination surface and the inner inclination surface is produced because of an axial force of the screw.

14. A golf club comprising:

a shaft;

a head having a hosel hole;

a sleeve fixed to a tip end portion of the shaft; and a screw capable of being screw-connected to the sleeve, wherein:

the sleeve includes at least one engaging projection part;

the head includes at least one engaging recess part;

a rotation of the sleeve with respect to the hosel hole is regulated based on an engagement between the engaging projection part and the engaging recess part;

a falling-off of the sleeve from the hosel hole is regulated based on a connection between the screw and the sleeve inserted to the hosel hole;

the engaging projection part includes a first side surface located on a side which receives a rotating force caused by hitting, a second side surface located on an opposite side to the first side surface, and an outer surface extending between the first side surface and the second side surface;

the engaging recess part includes a first opposed surface opposed to the first side surface, a second opposed surface opposed to the second side surface, and an inner surface opposed to the outer surface;

the engaging projection part includes a tapered projection part formed such that a distance between the first side surface and the second side surface decreases toward a tip end of the sleeve;

a maximum width of the tapered projection part is equal to or greater than an opening width of the engaging recess part;

at least one of the first side surface and the first opposed surface extends along the axial direction; and the engaging recess part includes a tapered recess part formed such that a distance between the first opposed surface and the second opposed surface decreases toward the tip end of the sleeve.

15. A golf club comprising:

a shaft;

a head having a hosel hole;

a sleeve fixed to a tip end portion of the shaft; and a screw capable of being screw-connected to the sleeve, wherein:

the sleeve includes at least one engaging projection part;

the head includes at least one engaging recess part;

a rotation of the sleeve with respect to the hosel hole is regulated based on an engagement between the engaging projection part and the engaging recess part;

a falling-off of the sleeve from the hosel hole is regulated based on a connection between the screw and the sleeve inserted to the hosel hole;

the engaging projection part includes a first side surface located on a side which receives a rotating force caused by hitting, a second side surface located on an opposite side to the first side surface, and an outer surface extending between the first side surface and the second side surface;

the engaging recess part includes a first opposed surface opposed to the first side surface, a second opposed surface opposed to the second side surface, and an inner surface opposed to the outer surface;

the engaging projection part includes a tapered projection part formed such that a distance between the first side surface and the second side surface decreases toward a tip end of the sleeve;

a maximum width of the tapered projection part is equal to or greater than an opening width of the engaging recess part;

at least one of the first side surface and the first opposed surface extends along the axial direction; and the inner surface includes an inner inclination surface inclined so as to go toward a radial-direction inner side as approaching to the tip end of the sleeve.

16. A golf club comprising:

a shaft;

a head having a hosel hole;

a sleeve fixed to a tip end portion of the shaft; and a screw capable of being screw-connected to the sleeve, wherein:

the sleeve includes at least one engaging projection part;

the head includes at least one engaging recess part;

a rotation of the sleeve with respect to the hosel hole is regulated based on an engagement between the engaging projection part and the engaging recess part;

a falling-off of the sleeve from the hosel hole is regulated based on a connection between the screw and the sleeve inserted to the hosel hole;

the engaging projection part includes a first side surface located on a side which receives a rotating force caused by hitting, a second side surface located on an opposite side to the first side surface, and an outer surface extending between the first side surface and the second side surface;

the engaging recess part includes a first opposed surface opposed to the first side surface, a second opposed surface opposed to the second side surface, and an inner surface opposed to the outer surface;

the engaging projection part includes a tapered projection part formed such that a distance between the first side surface and the second side surface decreases toward a tip end of the sleeve;

a maximum width of the tapered projection part is equal to or greater than an opening width of the engaging recess part;

at least one of the first side surface and the first opposed surface extends along the axial direction; and in a connected state where the sleeve is fixed to the head by tightening the screw, a contact pressure between the first side surface and the first opposed surface is produced because of an axial force of the screw.

17. A golf club comprising:

a shaft;

a head having a hosel hole;

a sleeve fixed to a tip end portion of the shaft; and a screw capable of being screw-connected to the sleeve, wherein:

the sleeve includes at least one engaging projection part;

the head includes at least one engaging recess part;

a rotation of the sleeve with respect to the hosel hole is regulated based on an engagement between the engaging projection part and the engaging recess part;

a falling-off of the sleeve from the hosel hole is regulated based on a connection between the screw and the sleeve inserted to the hosel hole;

the engaging projection part includes a first side surface located on a side which receives a rotating force caused by hitting, a second side surface located on an opposite side to the first side surface, and an outer surface extending between the first side surface and the second side surface;

the engaging recess part includes a first opposed surface opposed to the first side surface, a second opposed surface opposed to the second side surface, and an inner surface opposed to the outer surface;

the engaging projection part includes a tapered projection part formed such that a distance between the first side surface and the second side surface decreases toward a tip end of the sleeve;

a maximum width of the tapered projection part is equal to or greater than an opening width of the engaging recess part;

at least one of the first side surface and the first opposed surface extends along the axial direction;

the outer surface includes an outer inclination surface inclined so as to go toward a radial-direction inner side as approaching to the tip end of the sleeve;

the inner surface includes an inner inclination surface inclined so as to go toward the radial-direction inner side as approaching to the tip end of the sleeve; and in a connected state where the sleeve is fixed to the head by tightening the screw, a contact pressure between the outer inclination surface and the inner inclination surface is produced because of an axial force of the screw.

* * * * *